US012667212B2

(12) United States Patent
Webb et al.

(10) Patent No.: US 12,667,212 B2
(45) Date of Patent: Jun. 30, 2026

(54) ADJUSTABLE BEVERAGE CONTAINER HOLDER

(71) Applicant: Clutch Insulators, LLC, Franktown, VA (US)

(72) Inventors: Gabriel Reese Webb, Franktown, VA (US); Bryce Lynn Cahoon, Norfolk, VA (US)

(73) Assignee: Clutch Insulators, LLC, Franktown, VA (US)

( * ) Notice: Subject to any disclaimer, the term of this patent is extended or adjusted under 35 U.S.C. 154(b) by 25 days.

(21) Appl. No.: 18/905,244

(22) Filed: Oct. 3, 2024

(65) Prior Publication Data

US 2025/0113935 A1 Apr. 10, 2025

Related U.S. Application Data

(60) Provisional application No. 63/543,326, filed on Oct. 10, 2023.

(51) Int. Cl.
*B60N 3/10* (2006.01)
*A47G 23/02* (2006.01)

(52) U.S. Cl.
CPC ..... *A47G 23/0216* (2013.01)

(58) Field of Classification Search
CPC ... A47G 23/0216; A47G 2400/08; B60N 3/10
USPC ..... 248/310, 230.8; 220/694, 737; 215/393, 215/395
See application file for complete search history.

(56) References Cited

U.S. PATENT DOCUMENTS

| | | | | |
|---|---|---|---|---|
| 3,285,456 | A | 11/1966 | Pewitt | |
| 5,071,096 | A | 12/1991 | Hartman et al. | |
| 6,070,844 | A * | 6/2000 | Salenbauch | B60N 3/101 248/314 |
| 6,588,621 | B2 | 7/2003 | Shimazaki | |
| 8,544,678 | B1 | 10/2013 | Hughes | |
| 9,408,779 | B2 | 8/2016 | Stewart | |
| 9,801,483 | B2 | 10/2017 | D'Alesio | |

(Continued)

FOREIGN PATENT DOCUMENTS

WO 2020074427 4/2020

*Primary Examiner* — Nathan J Jenness
*Assistant Examiner* — Elizabeth J Volz
(74) *Attorney, Agent, or Firm* — Williams Mullen; F. Michael Sajovec

(57) ABSTRACT

A beverage container holder is provided and may include a container receiving portion, a deformable or flexible sleeve and a securing ring rotatable relative to the container receiving portion. The securing ring may include an inner ring portion and an outer ring portion wherein the deformable material is positioned or clasped between the inner ring portion and the outer ring portion of the securing ring. The can receiving portion may include a slot configured to receive a tab. The tab may be disposed on the interior portion of the securing ring to guide rotation of the securing ring from a container receiving configuration to a container securing configuration. The first end of the deformable sleeve may be coupled to the container receiving portion and a second end of the deformable sleeve may be coupled to the securing ring such that rotation of the securing ring from the container receiving configuration to the container securing configuration reduces an interior diameter of the deformable sleeve.

17 Claims, 35 Drawing Sheets

(56) References Cited

U.S. PATENT DOCUMENTS

| | | | |
|---|---|---|---|
| 2005/0082248 | A1 | 4/2005 | Al-Jadda et al. |
| 2005/0189459 | A1 | 9/2005 | Sturt et al. |
| 2009/0266737 | A1 | 10/2009 | Cole |
| 2012/0193366 | A1 | 8/2012 | Miller |
| 2019/0168653 | A1 | 6/2019 | Kim |
| 2023/0180954 | A1 | 6/2023 | Kilguss |

* cited by examiner (SIDE)

(TOP)

(TOP)

(TOP)

(CROSS-SECTION)

(CROSS-SECTION)

(CROSS-SECTION)

(CROSS-SECTION)

ADJUSTABLE BEVERAGE CONTAINER HOLDER

The present application claims priority to Provisional Application No. 63/543,326 filed Oct. 10, 2023, the disclosure of which is incorporated herein in its entirety.

FIELD OF THE DISCLOSURE

The present disclosure relates to an adjustable beverage container holder that may conform to a wide variety of beverage containers having a range of sizes.

BACKGROUND

Alcoholic and non-alcoholic beverages come in a wide variety of cans and bottles that have an equally wide variety of shapes and sizes. For example, sodas generally come in standard twelve-ounce cans, alcoholic seltzers and ciders generally in a taller but skinnier twelve-ounce can, and beer in yet a different size can, particularly if more than twelve-ounces.

Moreover, beverage consumers often drink the beverage over time, and it is often desirable to maintain the initial temperature of the beverage. To this end, various ways of maintaining beverage temperature in the various cans and bottles have been provided, with cloth Koozies® being one of the most popular. Such Koozie® can holders hug the can due to the flexibility of the cloth, and may provide insulation. However, one has to have multiple sizes of the can holders to fit the various diameters and/or heights of beverage cans and bottles.

An alternative is a zippered sleeve such as described in U.S. Pat. No. 11,191,380 B2. The sleeve is adjustable between a first position and a second position using a zipper or other means of closings, such as a hook and loop closure. Such a sleeve, however, provides limited insulation and is not secure around the beverage container.

Therefore, there remains a need for an adjustable beverage container holder that can be adapted and conformed to fit a wide variety of beverage container sizes having a variety of diameters and heights.

SUMMARY OF THE DISCLOSURE

According to various embodiments of the invention, an adjustable container holder is provided. The beverage container holder may include a container receiving portion, a deformable or flexible sleeve and a securing ring rotatable relative to the container receiving portion. The securing ring may include an inner ring portion and an outer ring portion wherein the deformable material is positioned or clasped between the inner ring portion and the outer ring portion of the securing ring. The can receiving portion may include a slot configured to receive a tab. The tab may be disposed on the interior portion of the securing ring to guide rotation of the securing ring from a container receiving configuration to a container securing configuration.

The first end of the deformable sleeve may be coupled to the container receiving portion and a second end of the deformable sleeve may be coupled to the securing ring such that rotation of the securing ring from the container receiving configuration to the container securing configuration reduces an interior diameter of the deformable sleeve. In this matter, the sleeve may be tightened.

The features and advantages described in this disclosure and in the following detailed description are not all-inclusive. Many additional features and advantages will be apparent to one of ordinary skill in the relevant art in view of the drawings, specification, and claims hereof. Moreover, it should be noted that the language used in the specification has been principally selected for readability and instructional purposes and may not have been selected to delineate or circumscribe the inventive subject matter; reference to the claims is necessary to determine such inventive subject matter.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only one preferred embodiment of the invention and is therefore not to be considered limiting of its scope as the invention may admit to other equally effective embodiments.

Figure 1:
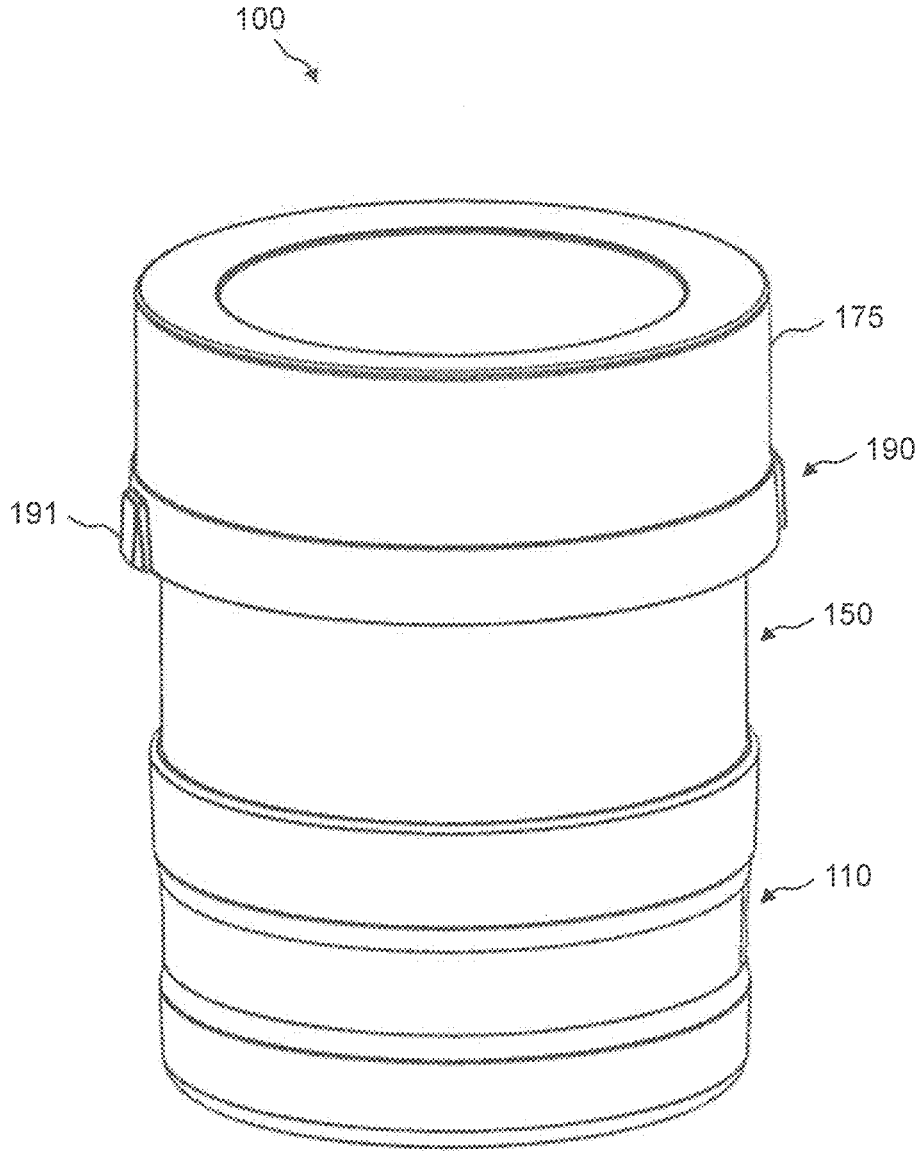
FIG. 1 is a perspective view of an adjustable beverage container holder in a relaxed configuration.

The figures depict embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Several embodiments will be described more fully in reference to the accompanying drawings. However, this disclosure should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

The terminology used herein is for the purposed of describing particular embodiments only and is not intended to be limiting of the invention. As used herein, the singular forms "a," "and," and "the" are intended to include the plural forms as well, unless the context clearly indicates otherwise.

It will be understood that when an element is referred to as being "attached," "coupled" or "connected" to another element, it can be directly attached, coupled or connected to the other element or intervening elements may also be present. In contrast, when an element is referred to as being "directly attached," "directly coupled" or "directly connected" to another element, there are no intervening elements present.

All patents, patent applications and publications referred to herein are incorporated by reference in their entirety. In case of a conflict in terminology, the present specification is controlling.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

In accordance with an embodiment of the invention, the adjustable beverage container holder 100 of the invention is shown in FIGS. 1-8. The adjustable beverage container holder includes a beverage holder base 110, an opening 120 for receiving a beverage container, a container receiving portion 150, including an upper receiving portion 155, a flexible or deformable sleeve 175 and a securing ring 190.

Figure 2:
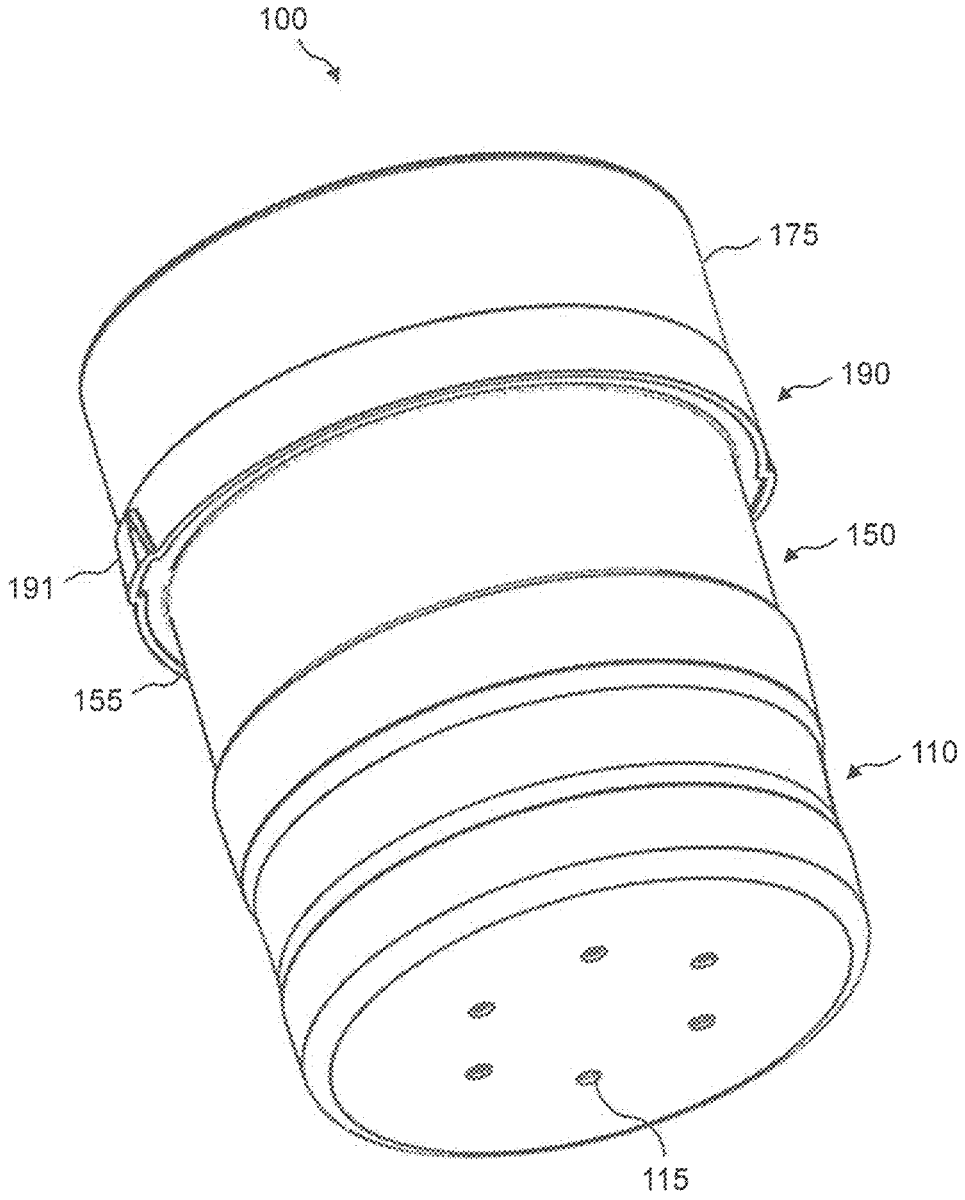
FIG. 2 is a rotated and extended perspective view of the adjustable beverage container holder.
Figure 3:
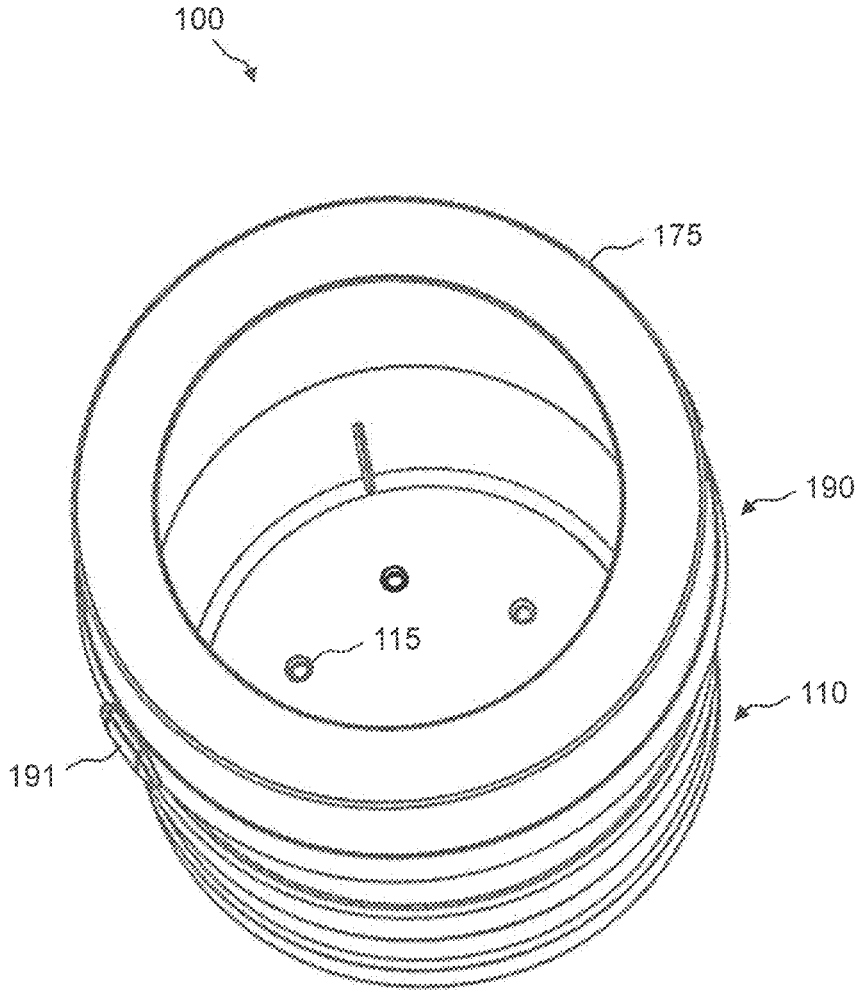
FIG. 3 is a top perspective view of the adjustable beverage container holder.
Figure 4:
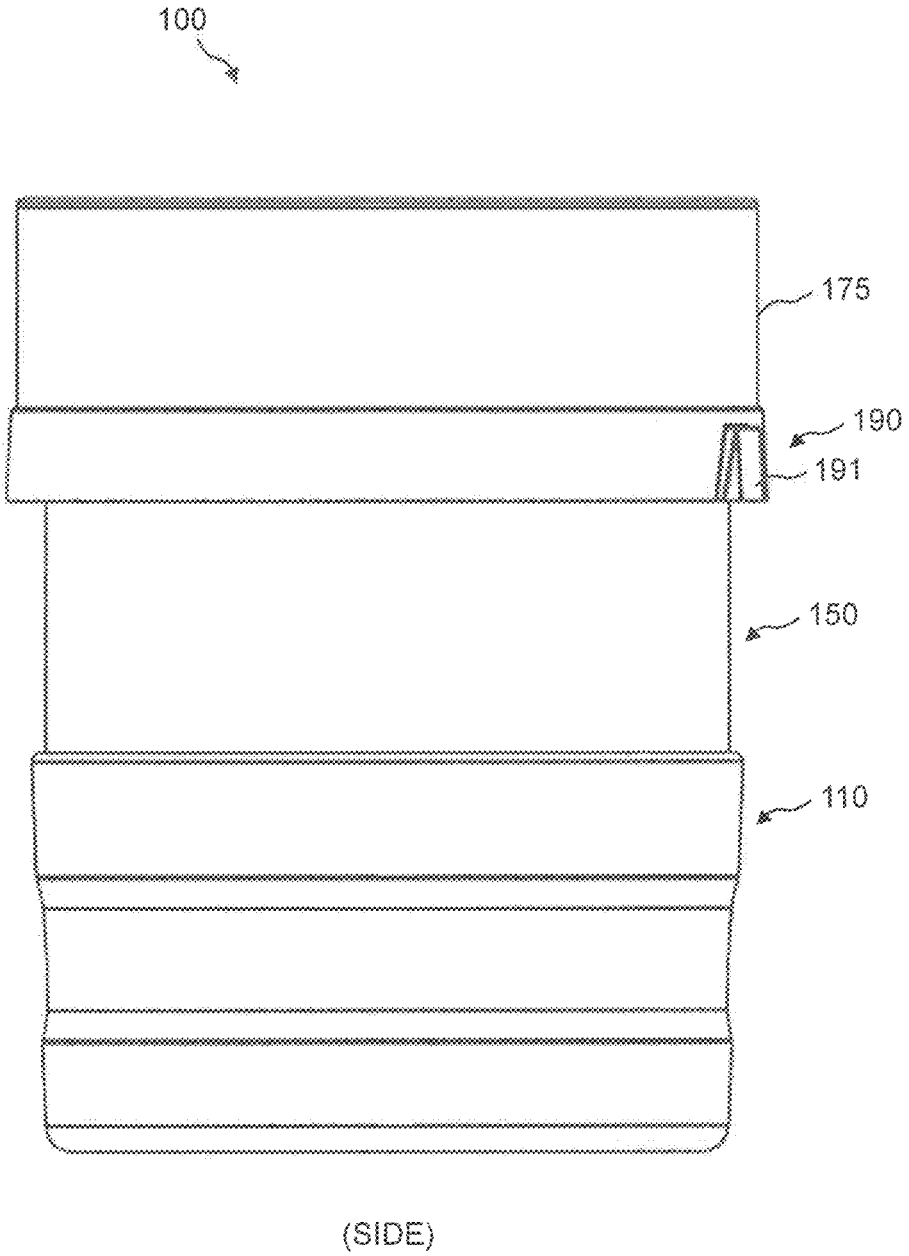
FIGS. 4-8 are side views of the adjustable beverage container holder.
Figure 5:
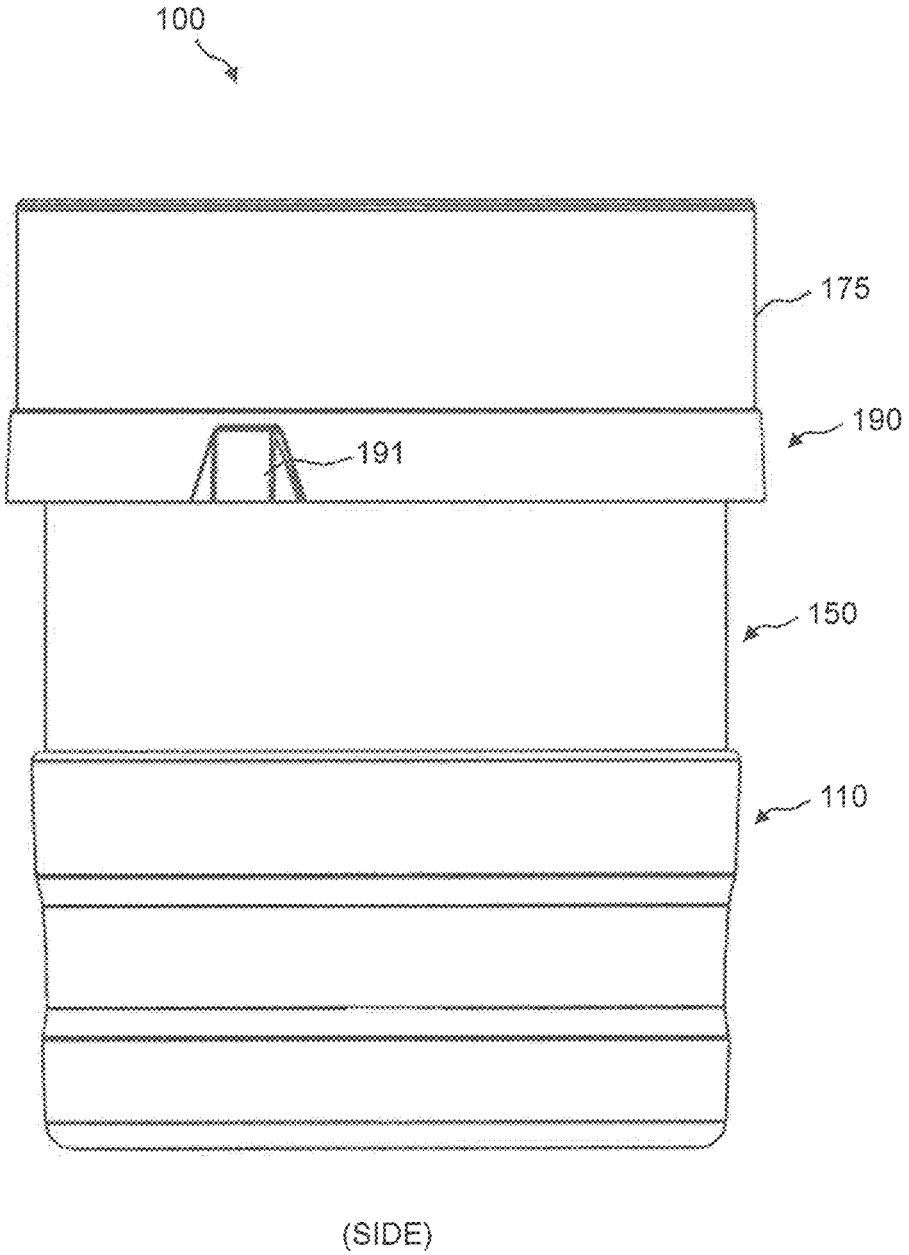
Figure 6:
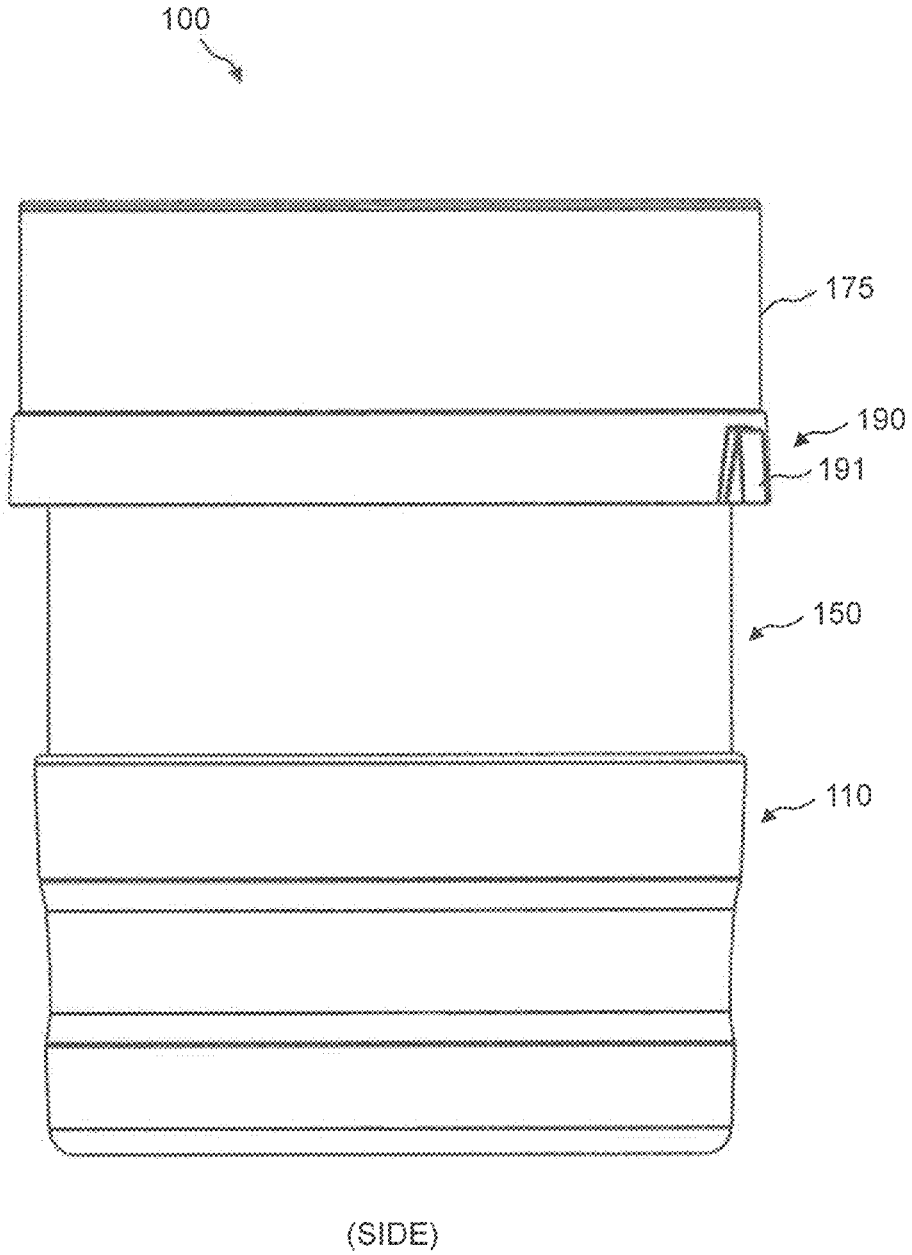
Figure 7:
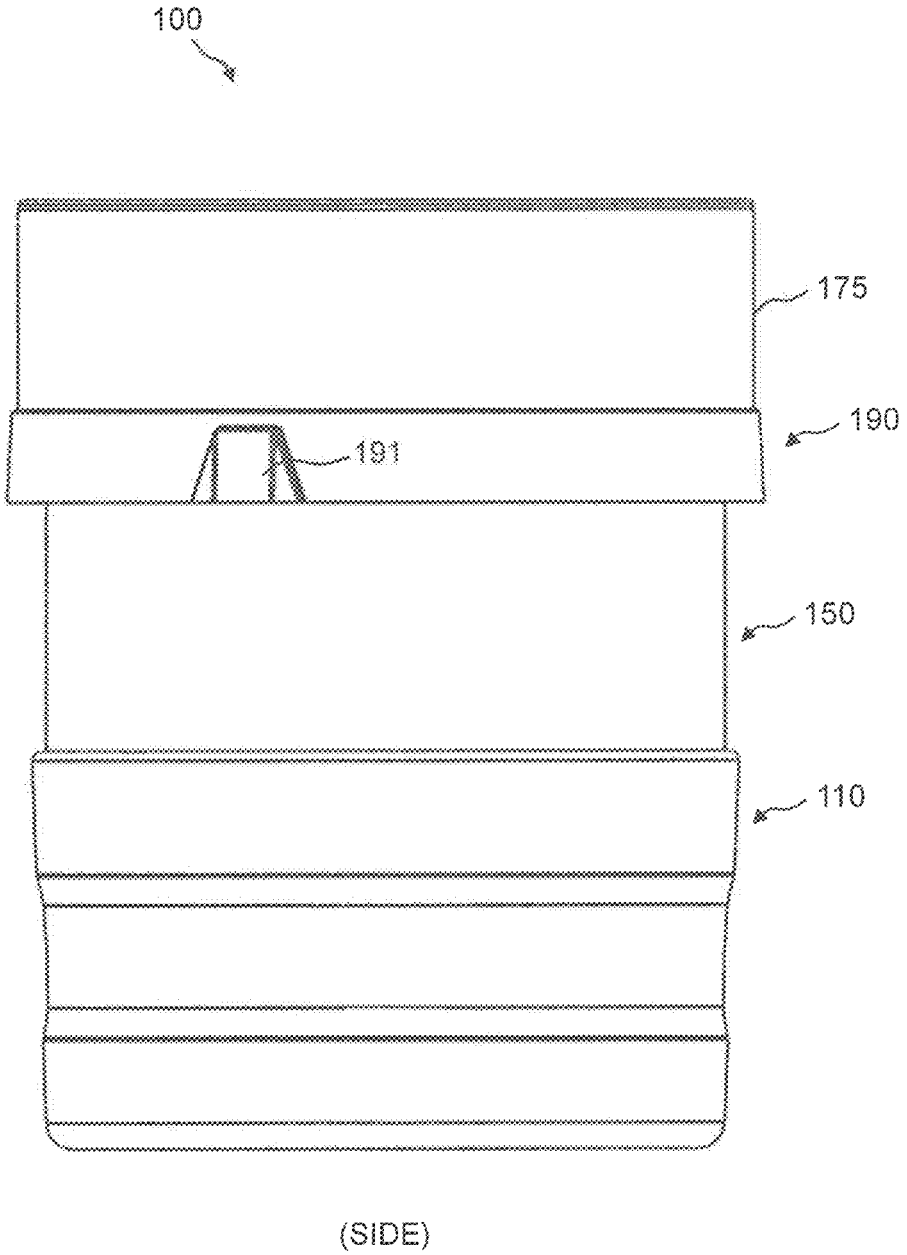
Figure 8:
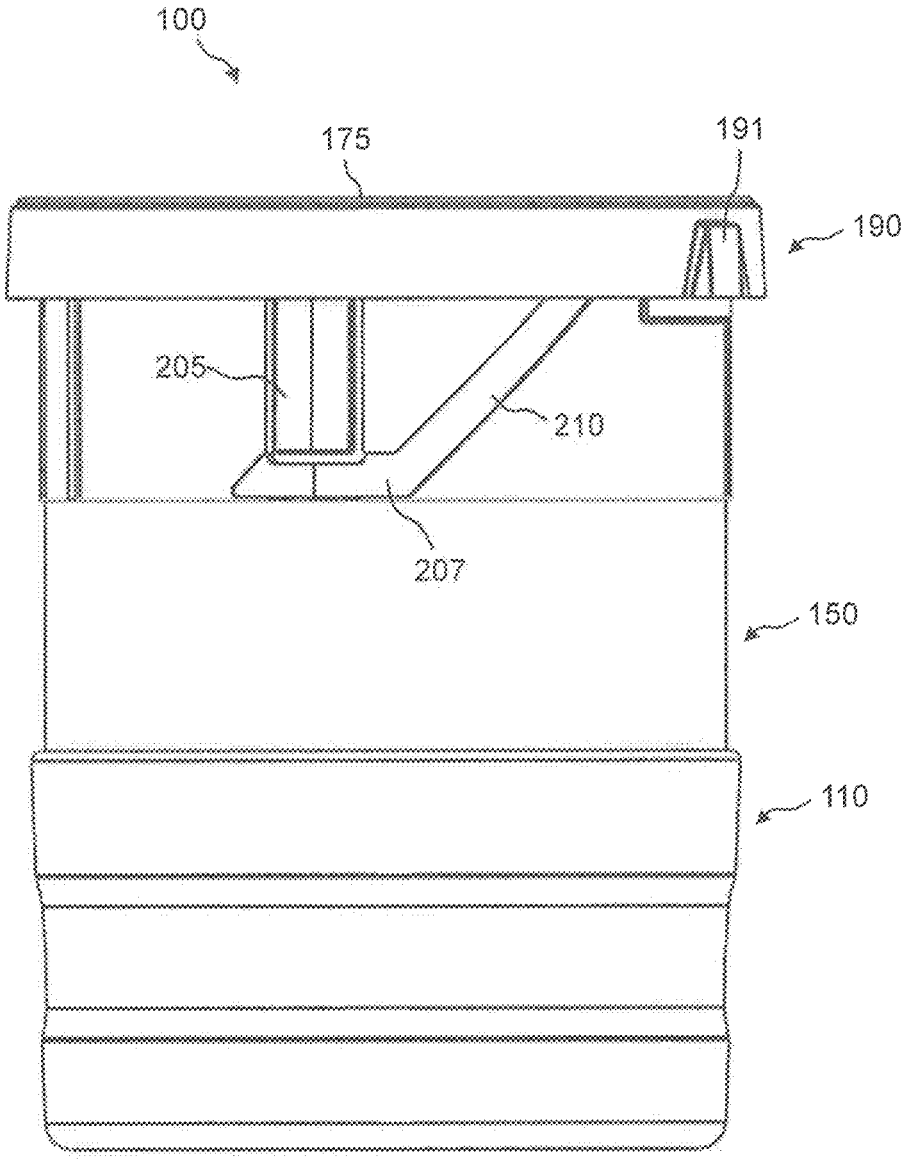

As shown in FIGS. 2 and 3, the beverage holder base 110 may include vent or drain opening 115. As shown in FIG. 8, The outer ring portion 190 may include one or more location tags 191 which may orient inner alignment tabs 255 (not shown in FIG. 8) with engagement snap tabs 205 for guiding the inner alignment tab 255 into a lower slider channel 207 and then moved upwards via a ramped channel 210 to an undercut 212, a step feature 215, and a cut out lock feature 217.

Figure 9:
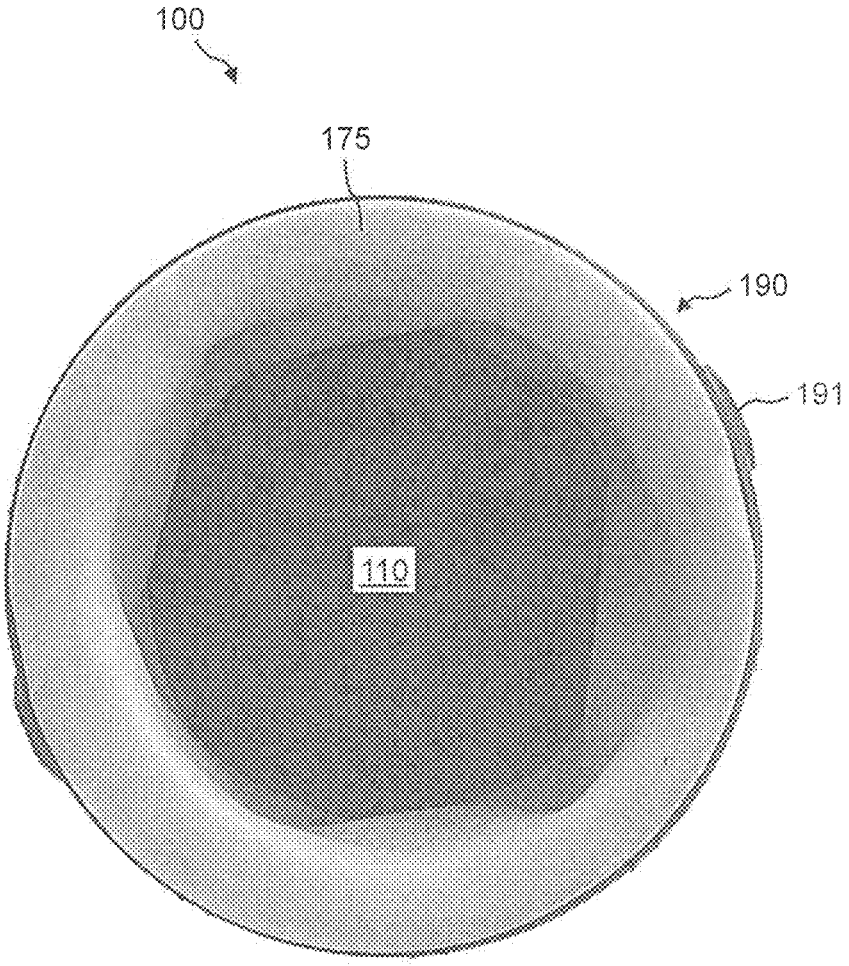
FIG. 9 is a top view of the adjustable beverage container holder in a relaxed configuration with no placement of a beverage container.
Figure 10:
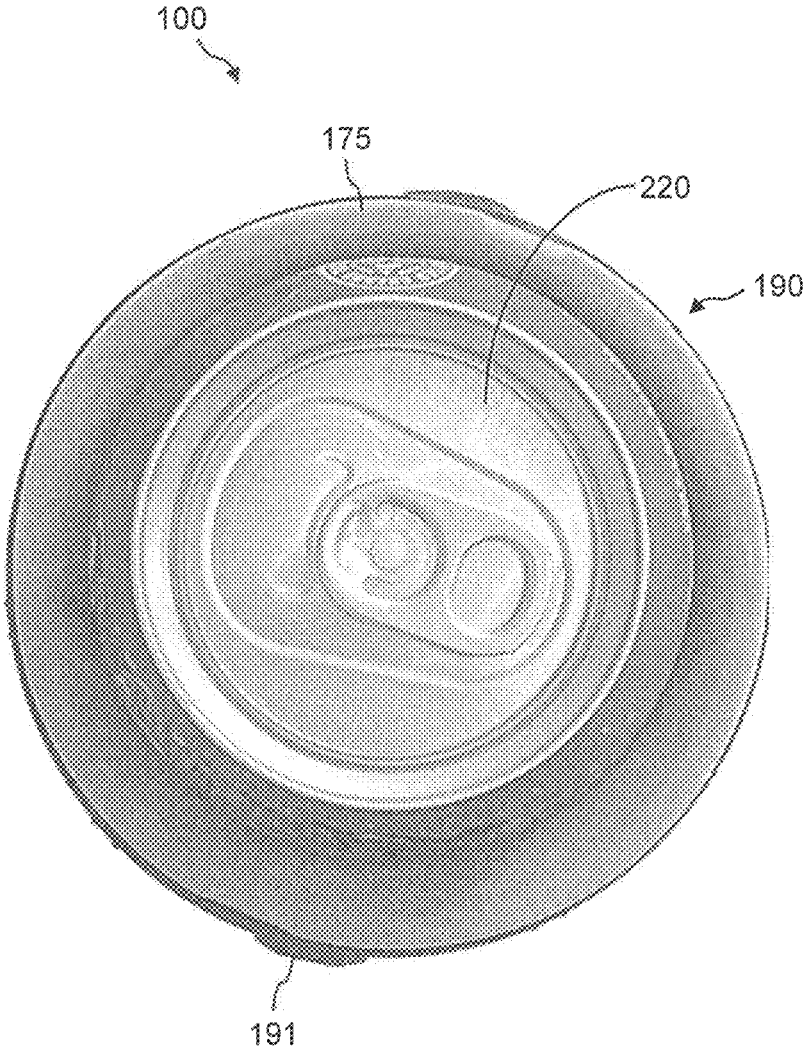
FIG. 10 is a top view of the adjustable beverage container holder in a relaxed configuration with placement of a beverage container.
Figure 11:
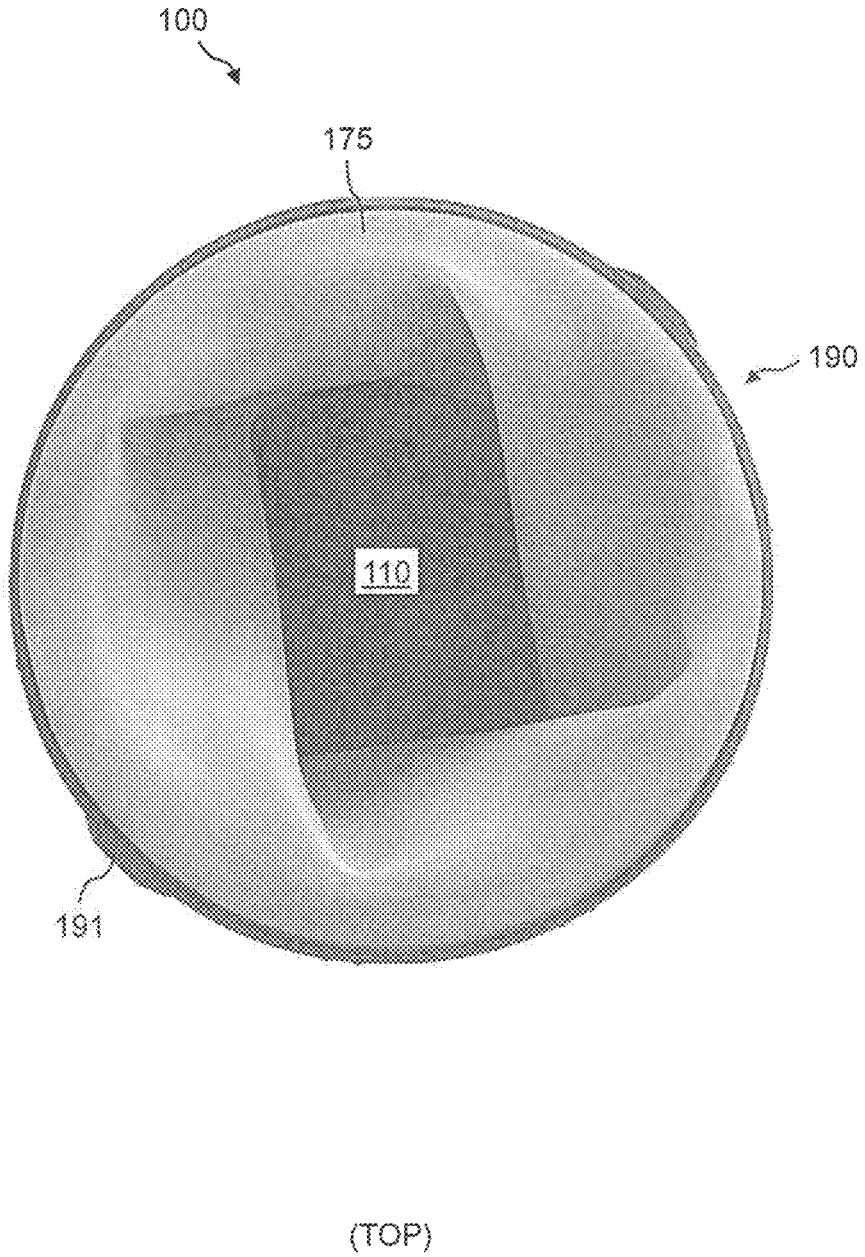
FIG. 11 is a top view of the adjustable beverage container holder in a constricted configuration with no placement of a beverage container.
Figure 12:
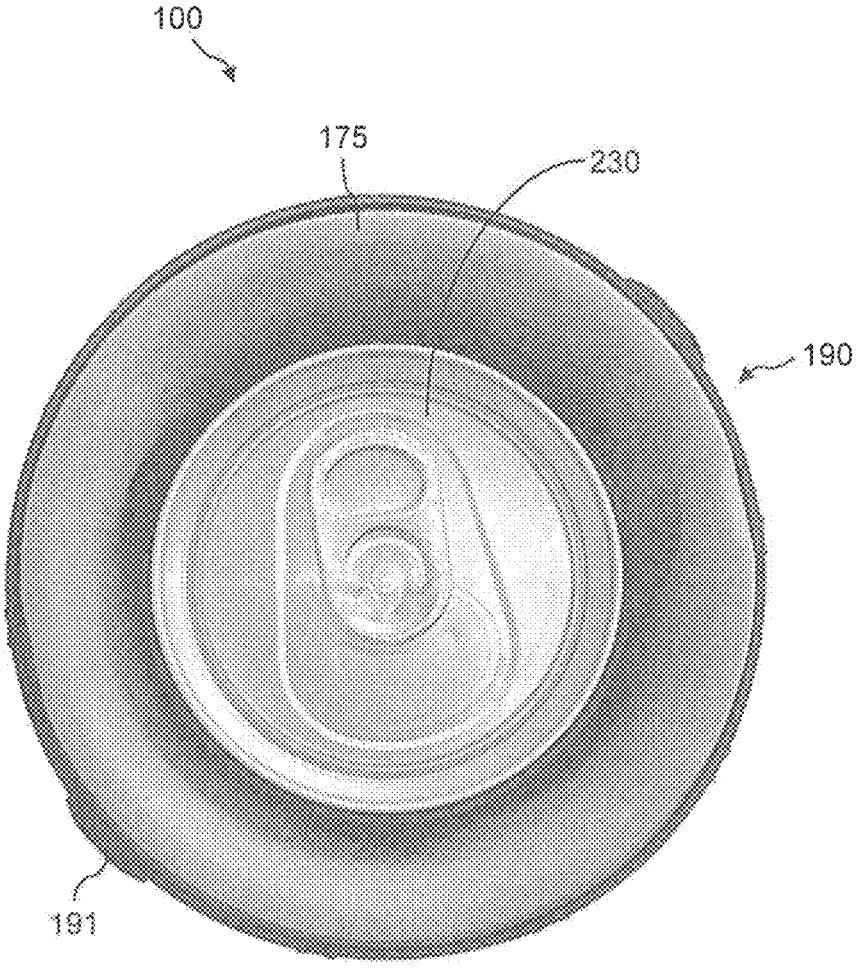
FIG. 12 is a top view of the adjustable beverage container holder in a constricted configuration with placement of a beverage container.
Figure 13:
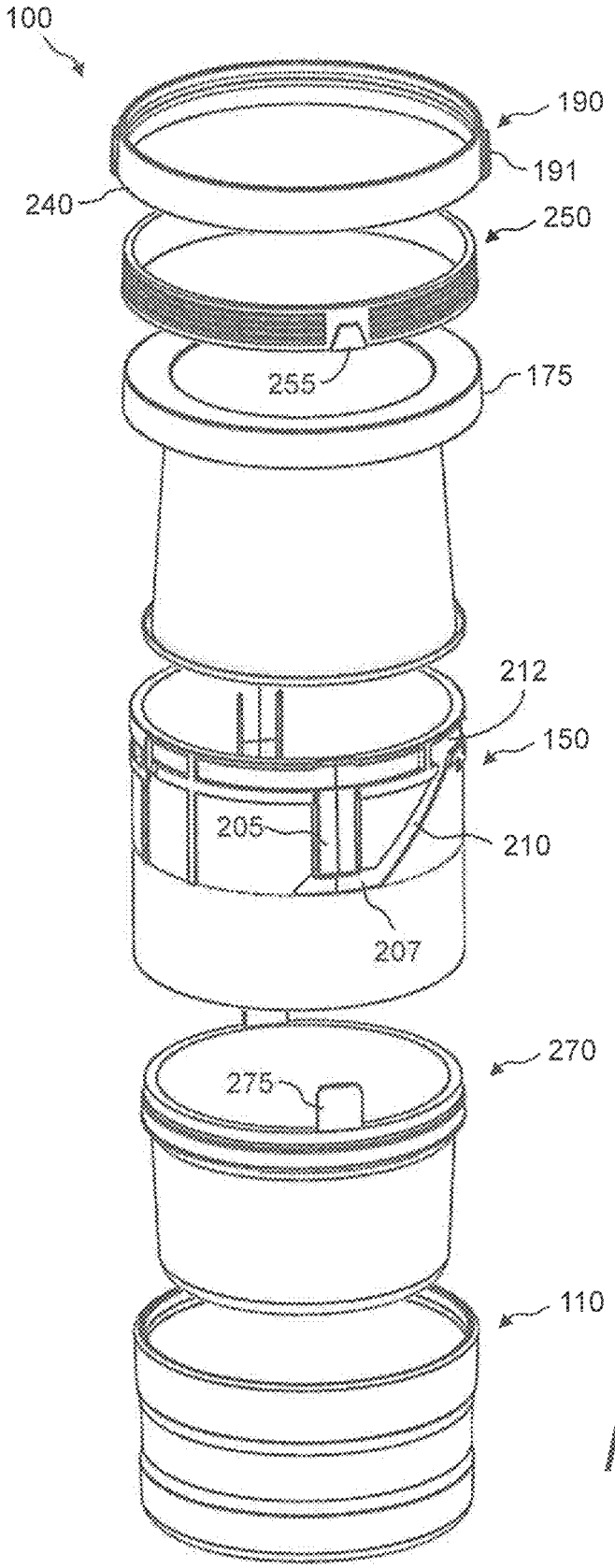
FIGS. 13 and 14 are exploded perspective views of the adjustable beverage container holder.
Figure 14:
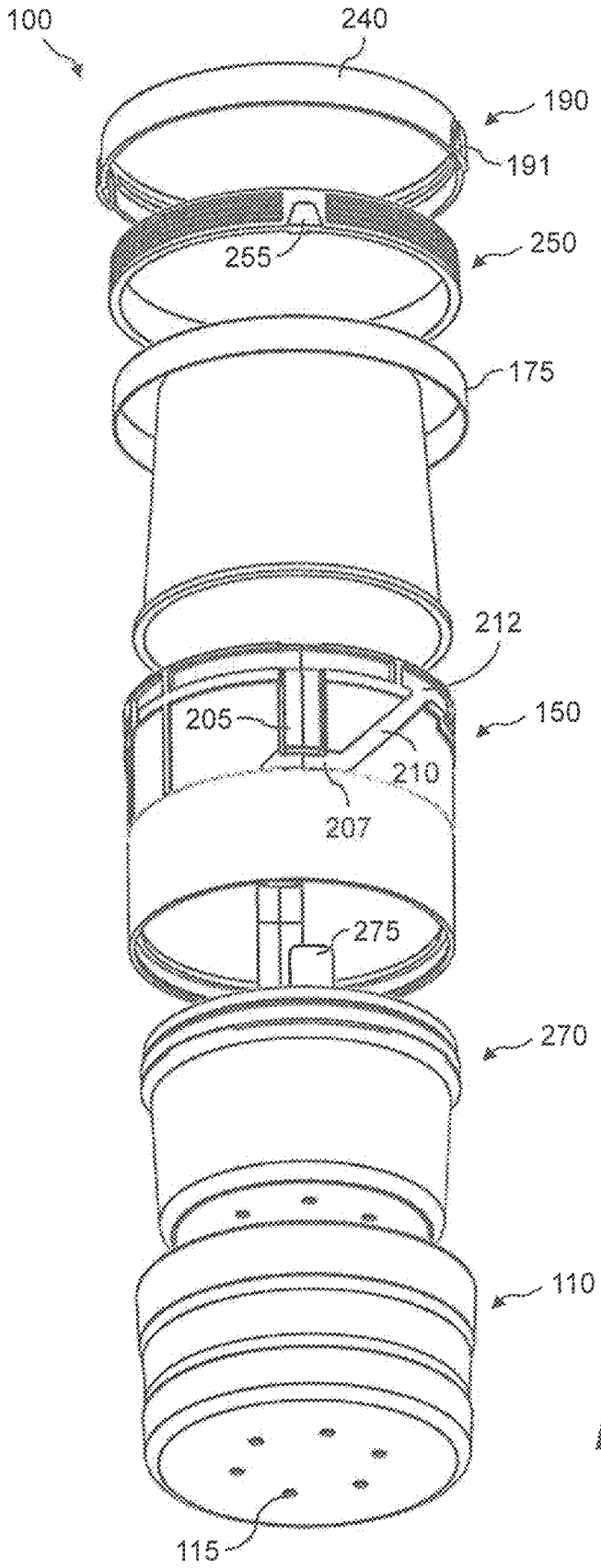
Figure 15:
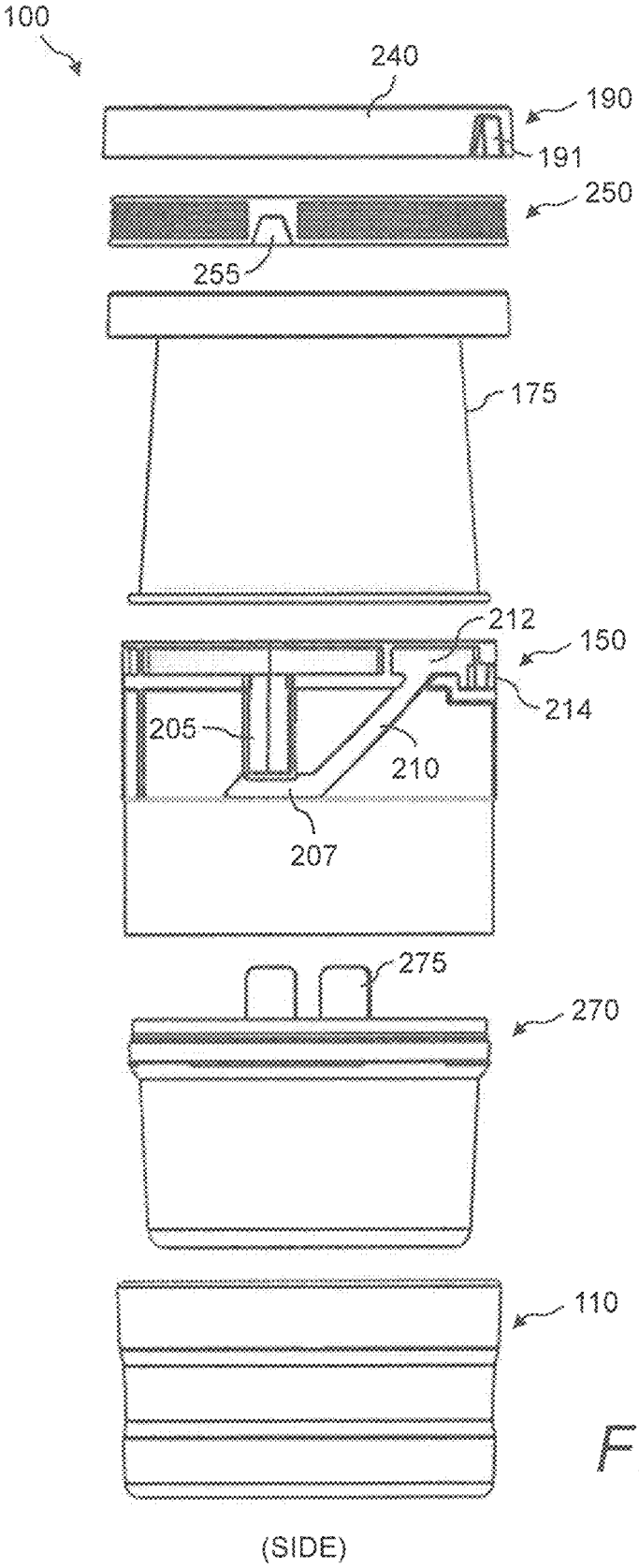
FIGS. 15 and 16 are exploded side views of the adjustable beverage container holder.
Figure 16:
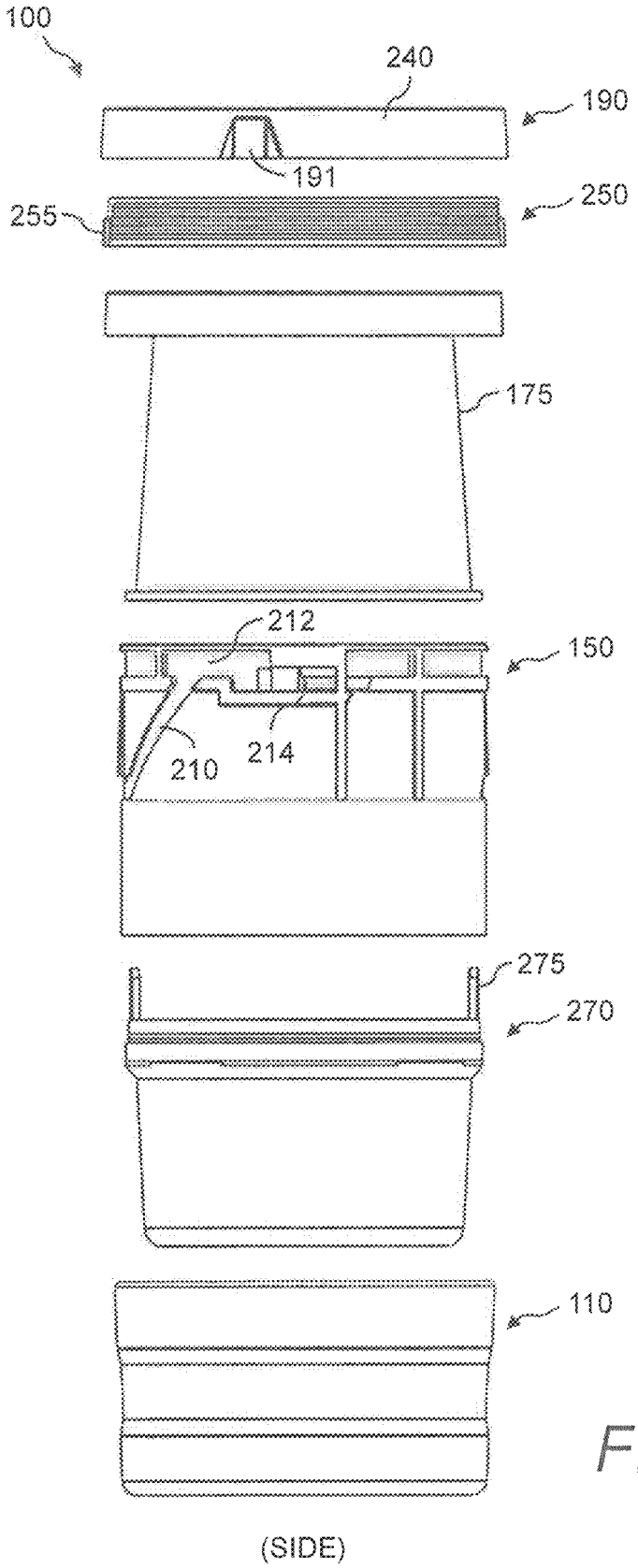

FIG. 9 shows the deformable sleeve 175 in a relaxed configuration without a beverage can. FIG. 10 shows the deformable sleeve 175 in a relaxed configuration with a larger in diameter beverage can 220 (e.g., a beer or soda can) positioned in the adjustable beverage container 100. FIG. 11 shows the deformable sleeve 175 in a constricted configuration without a beverage can. FIG. 12 shows the deformable sleeve 175 in a constricted configuration around a smaller in diameter beverage can 230 (e.g., a hard seltzer can). The deformable may be any flexible material such as a flexible polymeric material.

Referring to FIGS. 13-16, exploded views of the beverage holder 100 are shown. As shown, the securing ring 190 comprises an outer ring portion 240 and an inner ring portion 250. The securing ring may be placed over an upper portion of the deformable sleeve 175 such that it is gripped between the outer ring portion 240 and the inner ring portion 250. The lower portion of the deformable sleeve 175 fits in to the upper container receiving portion 155 of the container receiving portion 150 and may be wrapped around or otherwise engaged with a lower container receiving portion 270 which includes receiving portion alignment tabs 275. The lower container receiving portion 270 fits into the holder base 110.

Figure 17A:
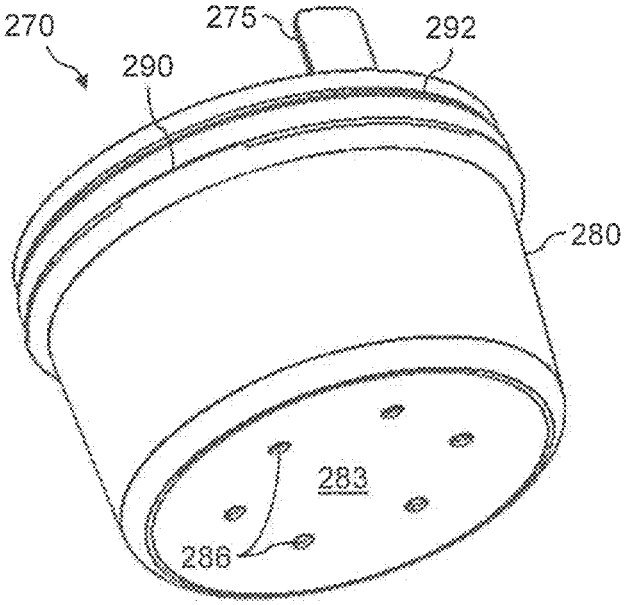
FIGS. 17A and 17B are perspective views of an inner liner of the adjustable beverage container holder.
Figure 17B:
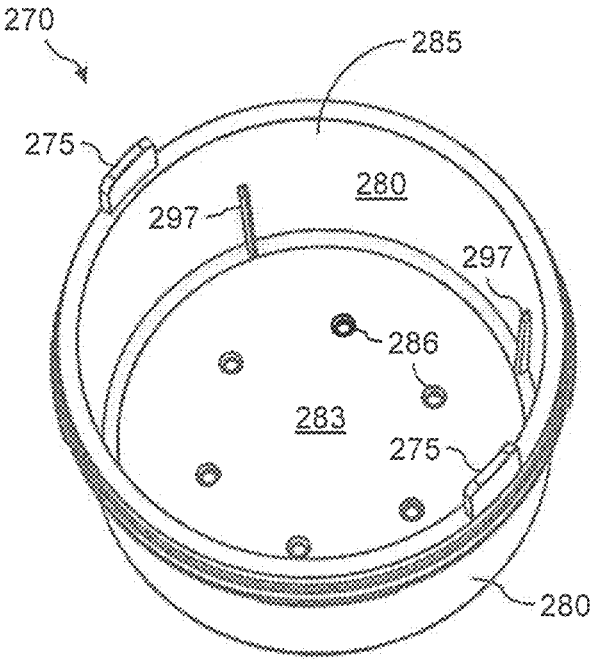
Figure 17C:
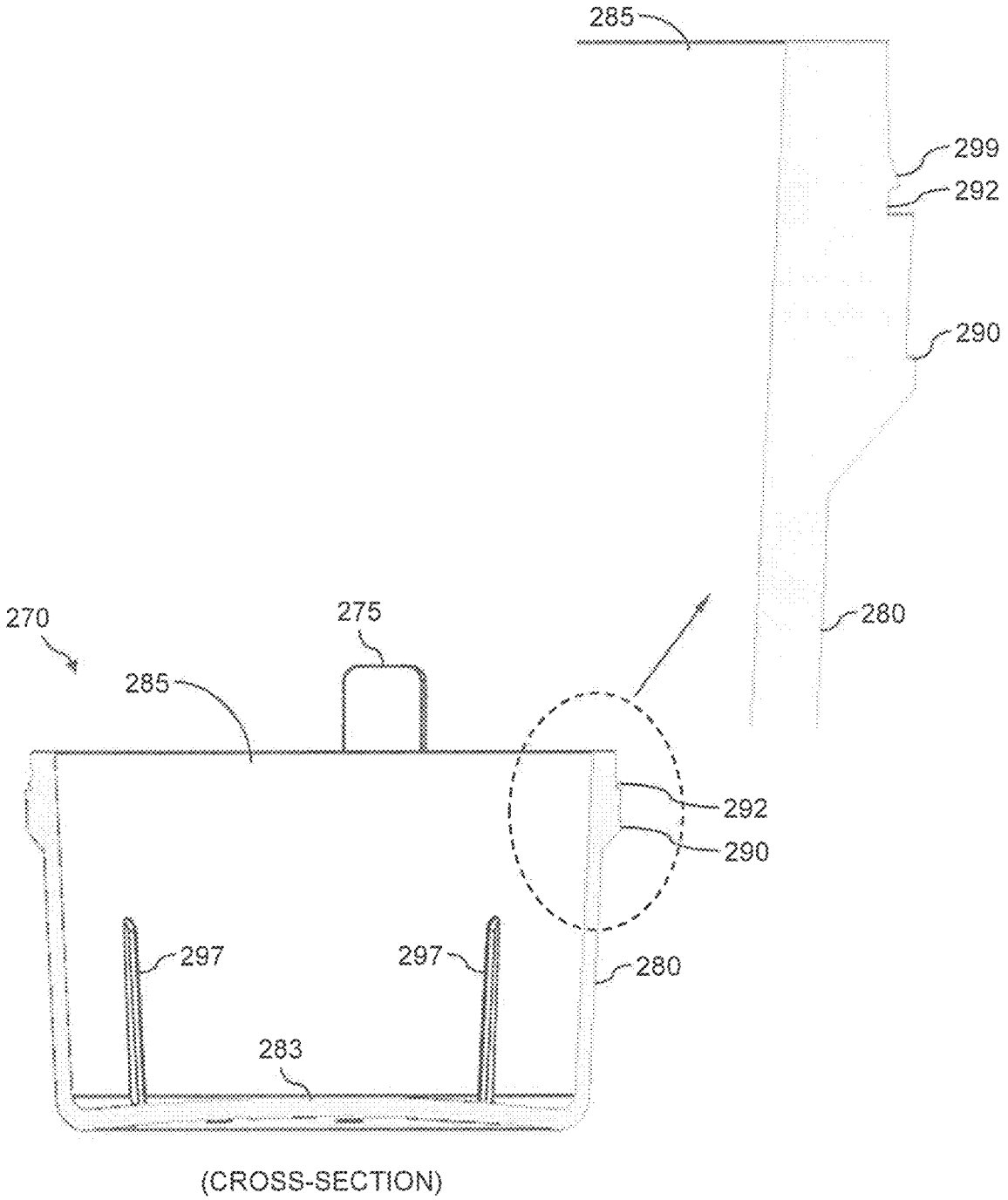
FIG. 17C is a cross-section of the lower receiving portion lower receiving portion with an enlarged view of the upper portion of the lower receiving portion.
Figure 17D:
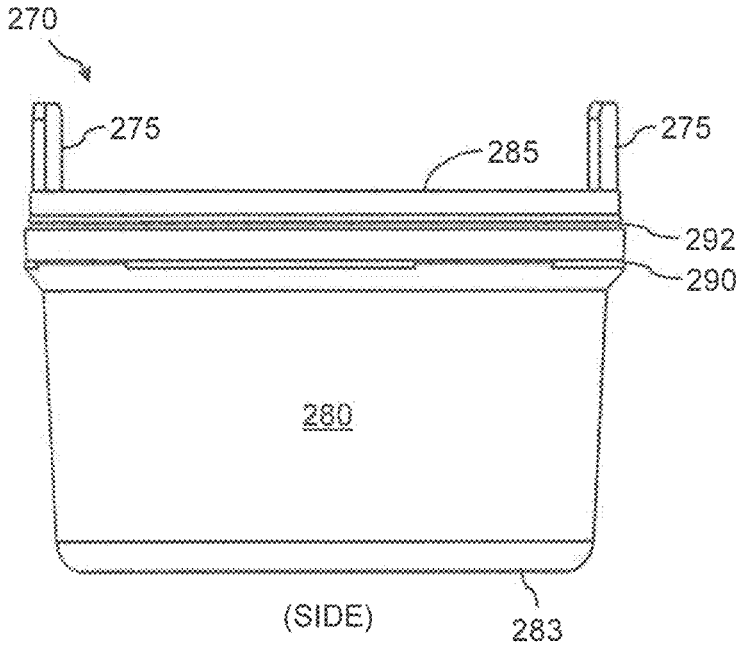
FIGS. 17D-17E are side views of the lower receiving portion of the adjustable beverage container holder.
Figure 17E:
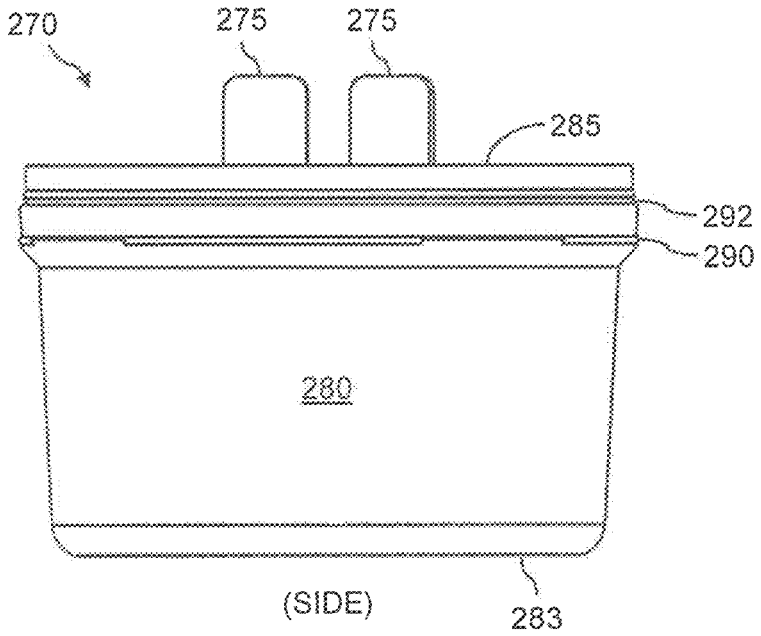
Figure 18A:
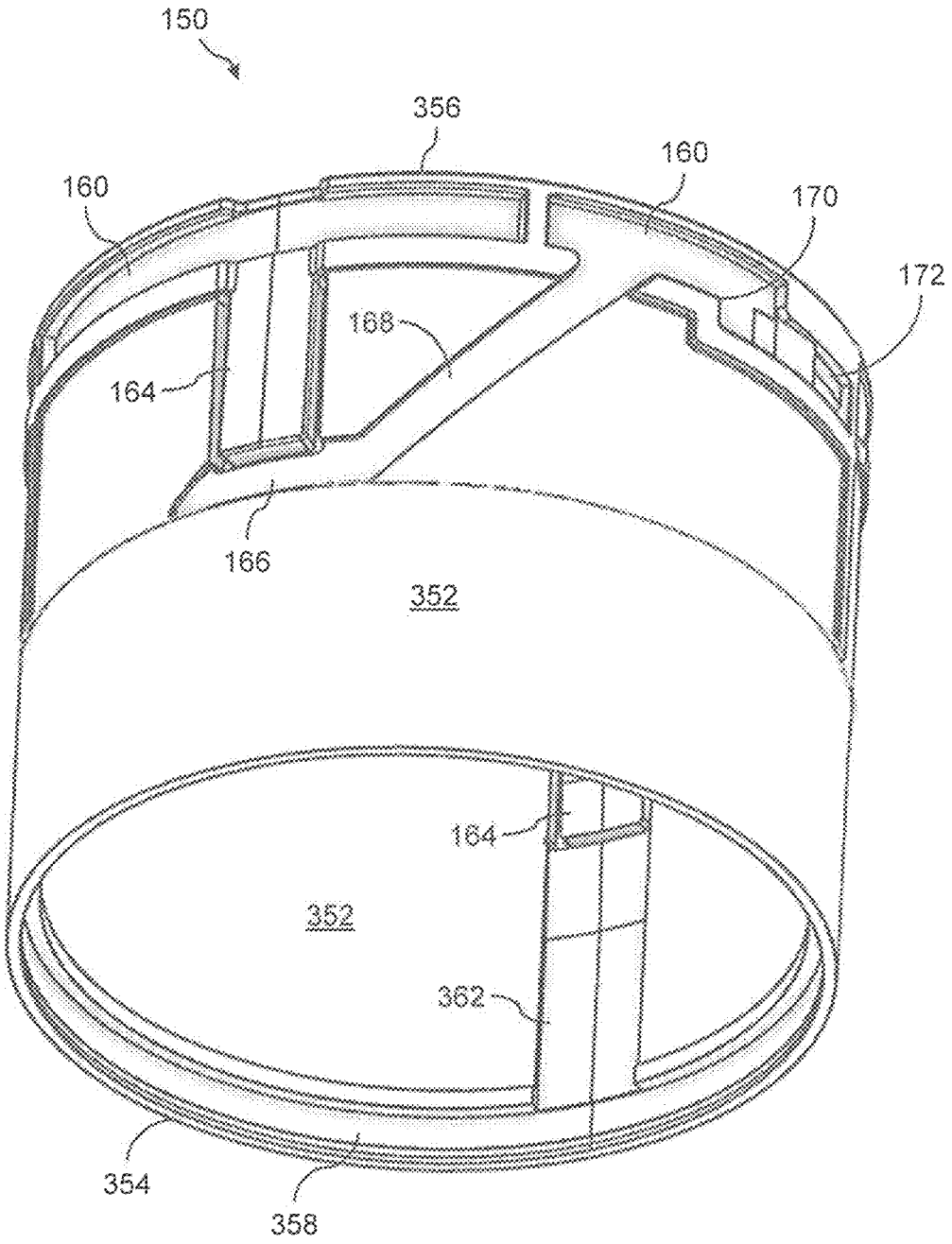
FIGS. 18A and 18B are perspective views of the upper receiving portion of the adjustable beverage container holder.
Figure 18B:
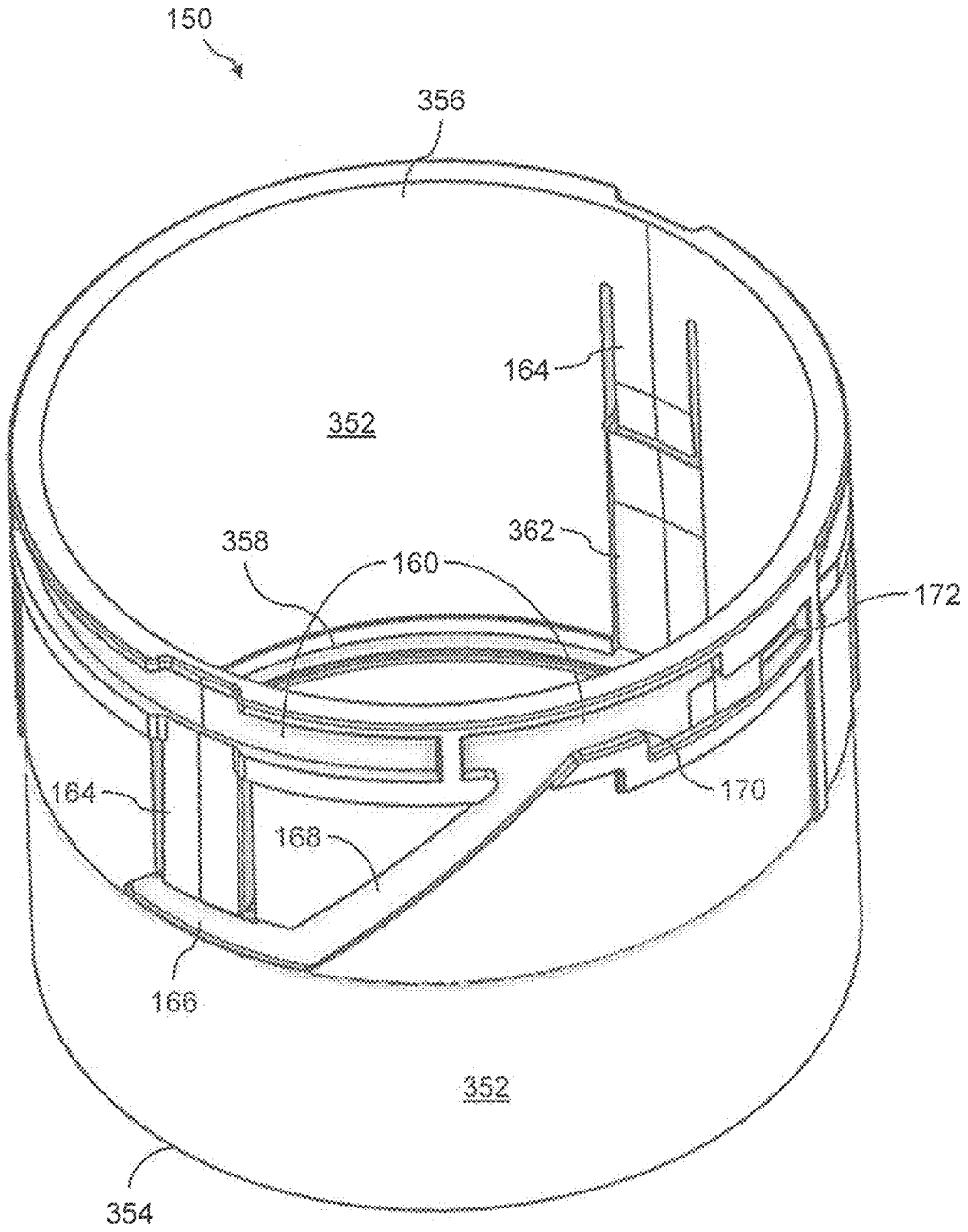
Figure 18C:
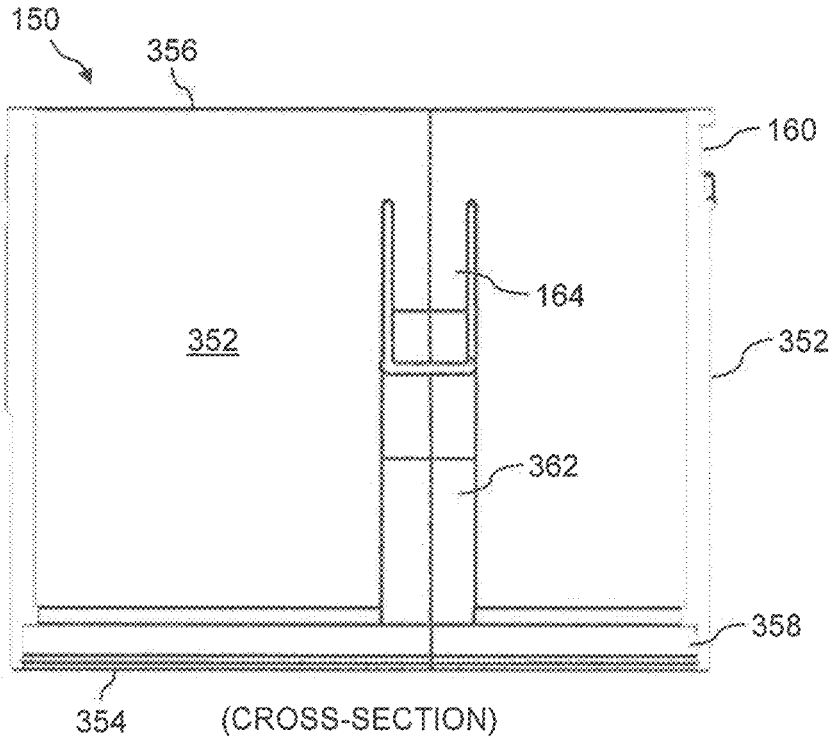
FIGS. 18C and 18D are cross-sectional views of the upper receiving portion of the adjustable beverage container holder.
Figure 18D:
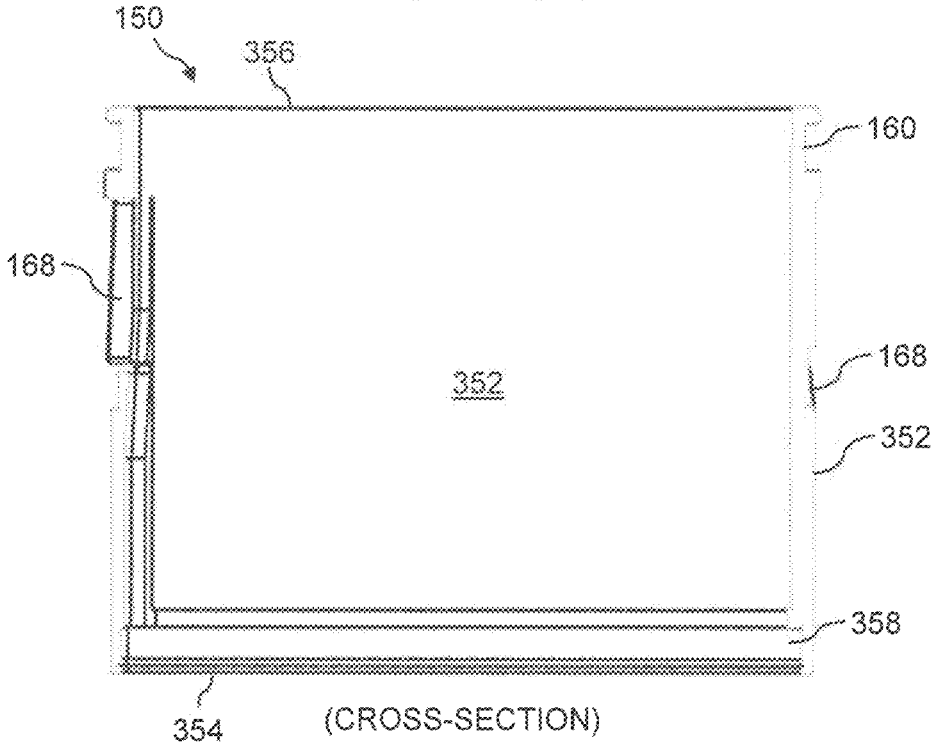
Figure 18E:
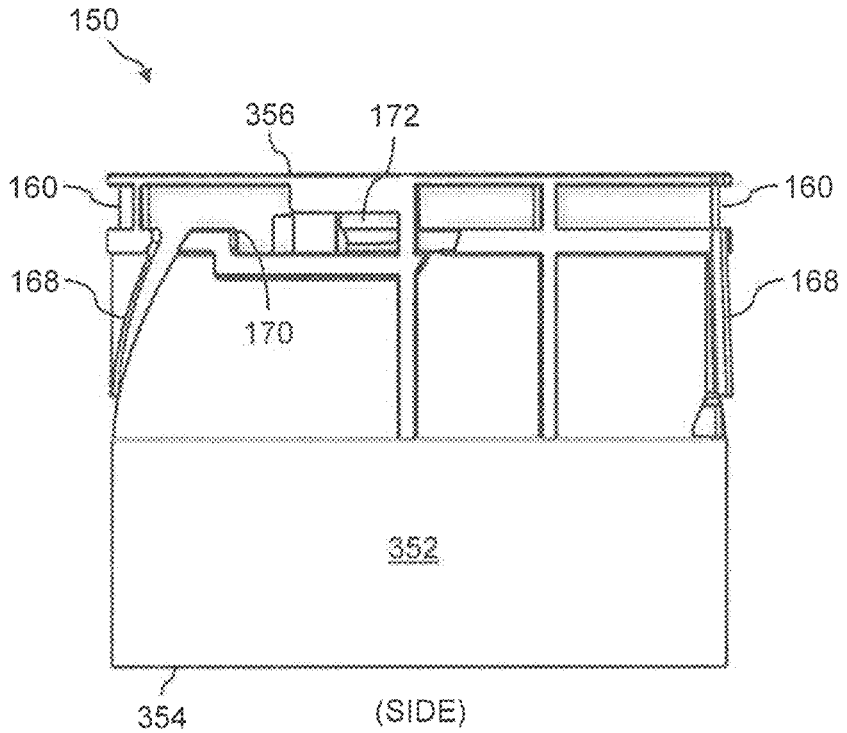
FIGS. 18E-18H are side views of the upper receiving portion of the adjustable beverage container holder.
Figure 18F:
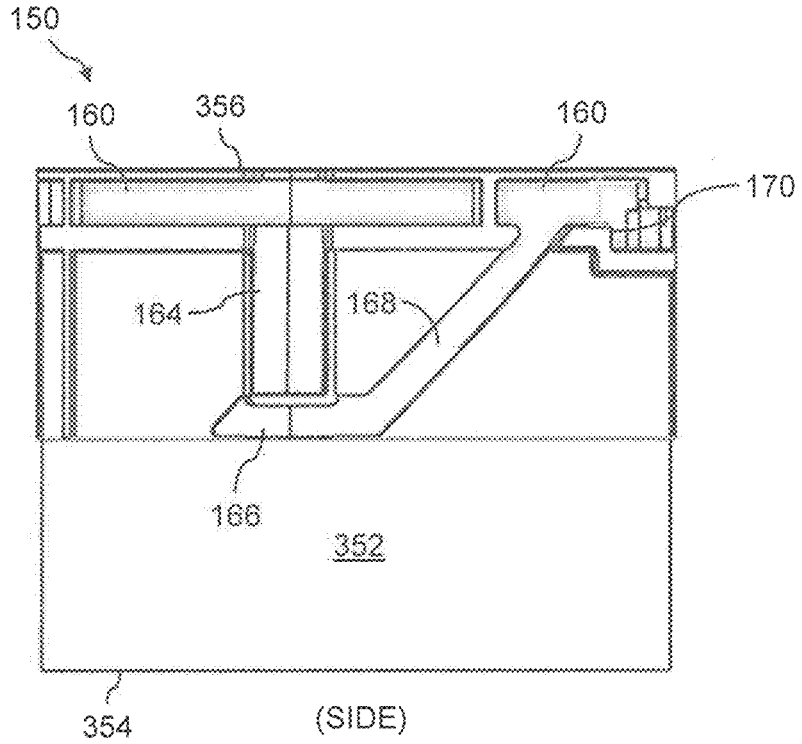
Figure 18G:
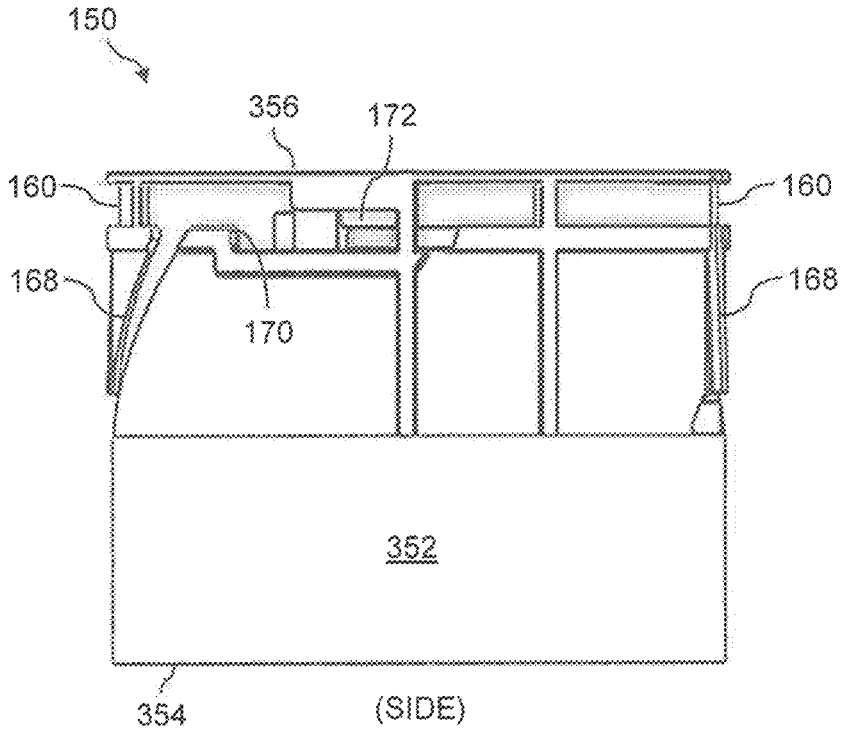
Figure 18H:
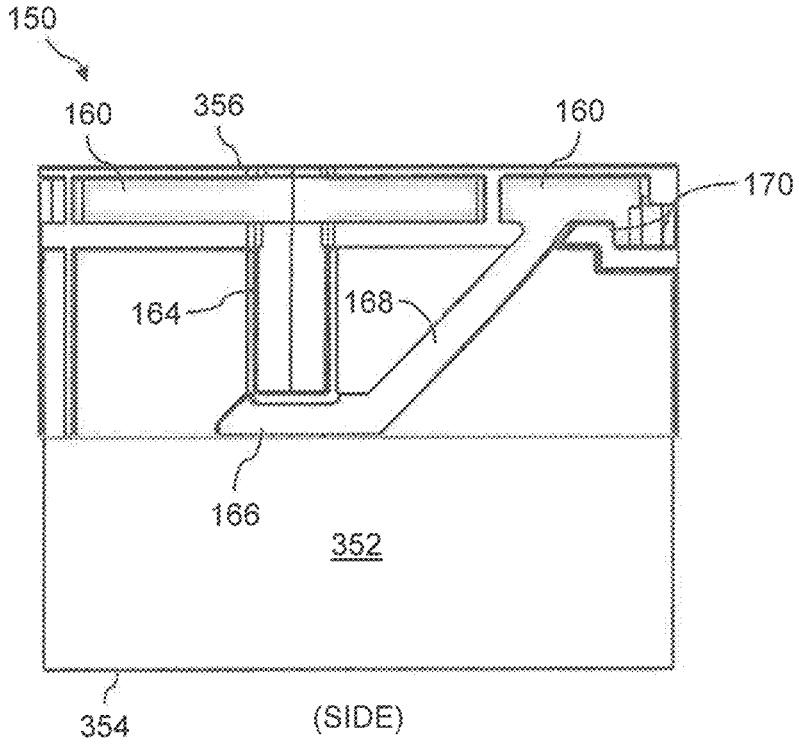
Figure 19A:
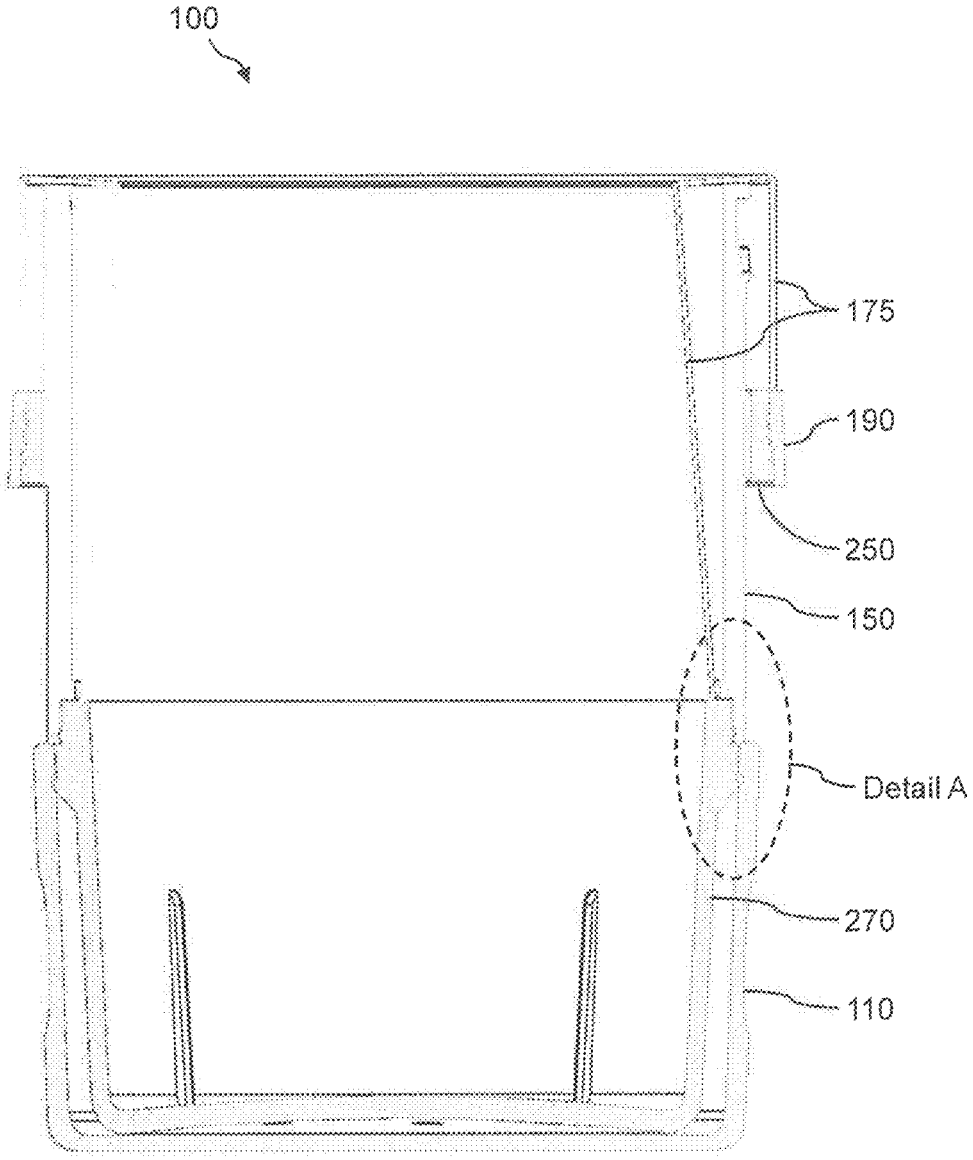
FIGS. 19A, 19B, 20A, and 20B are a cross-sectional view of the adjustable beverage container holder with the lower receiving portion mated to the upper receiving portion.
Figure 19B:
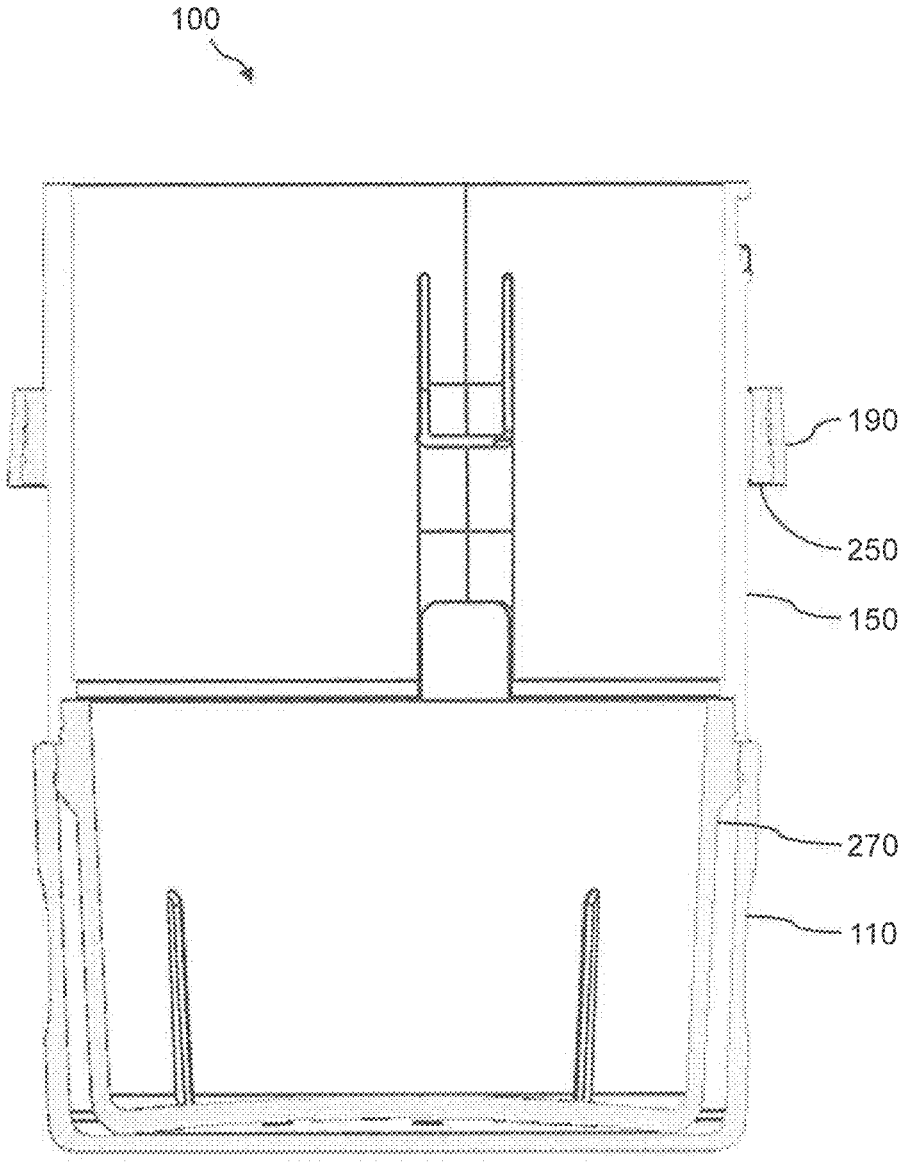
Figure 20A:
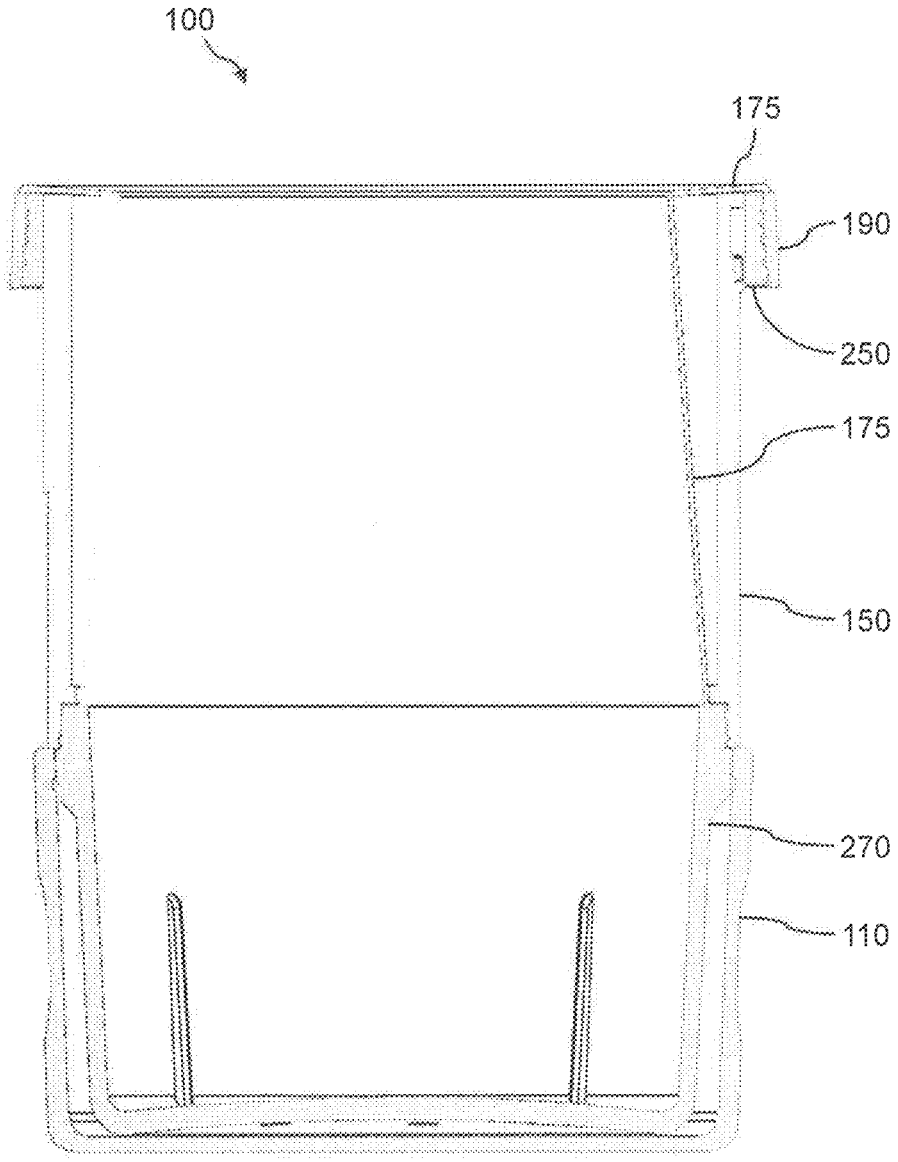
Figure 20B:
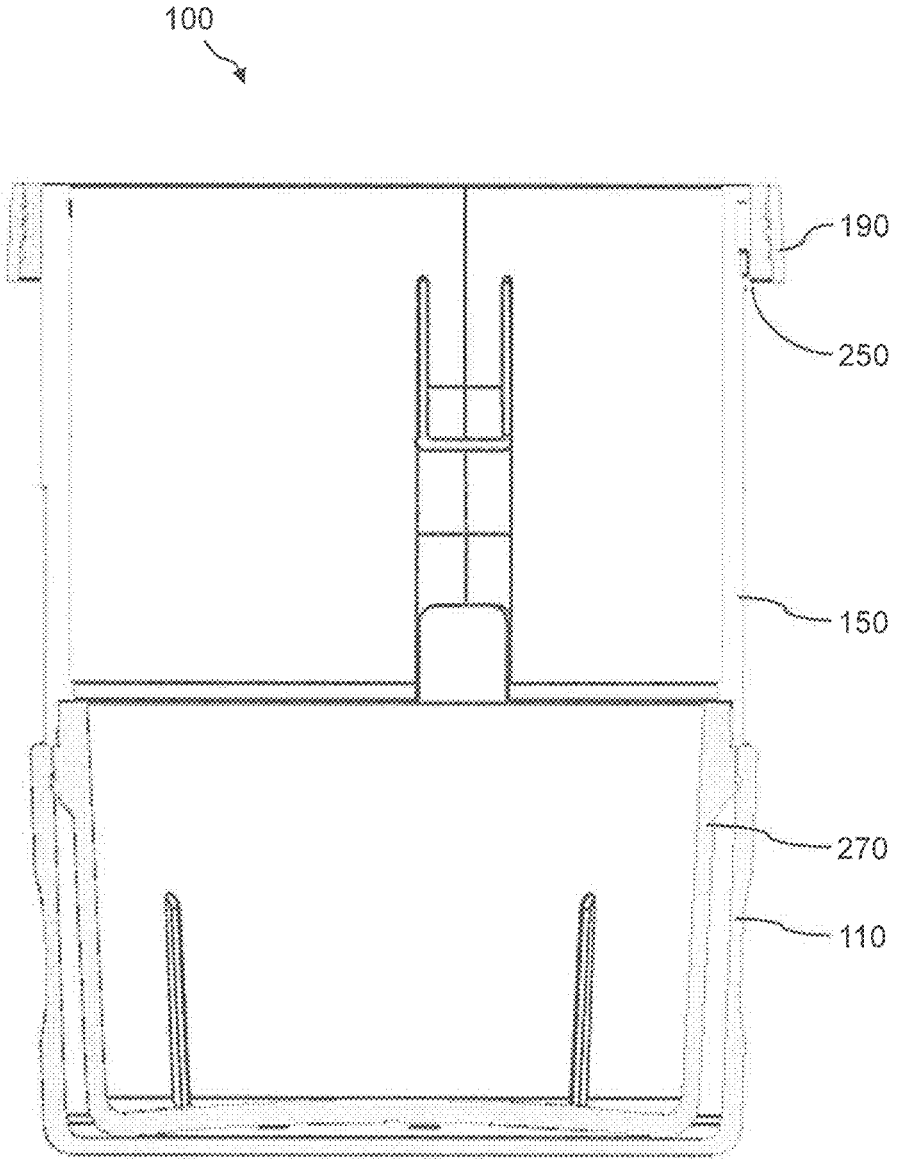
Figure 21:
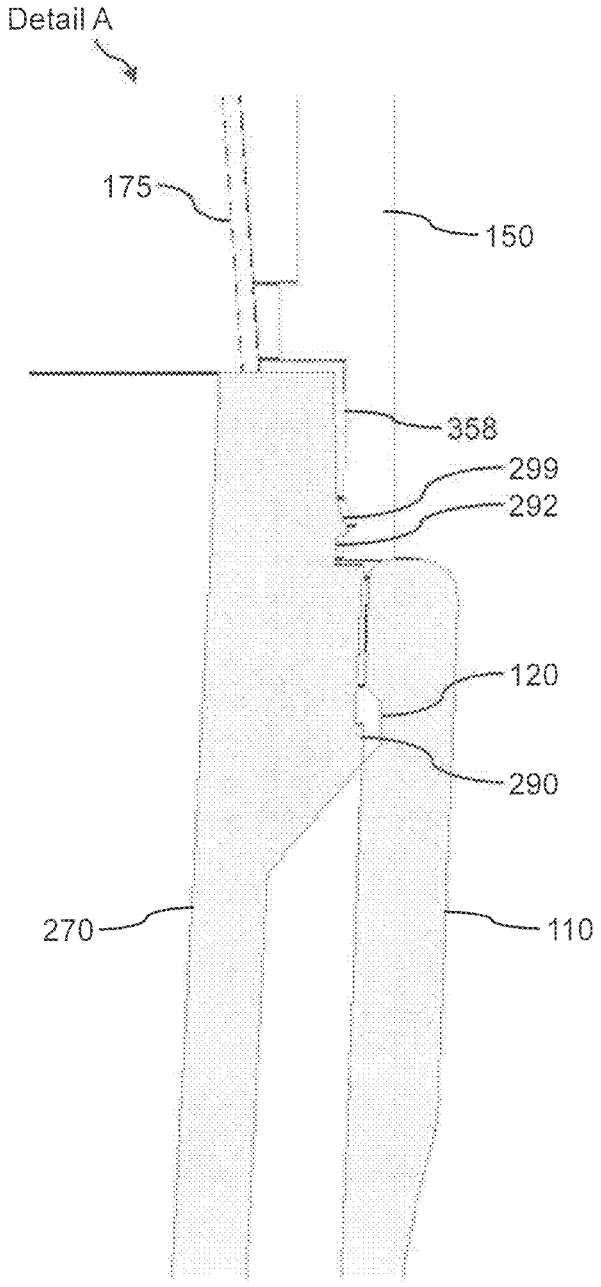
FIG. 21 is a cross-sectional view of Detail A of FIG. 19A.
Figure 22:
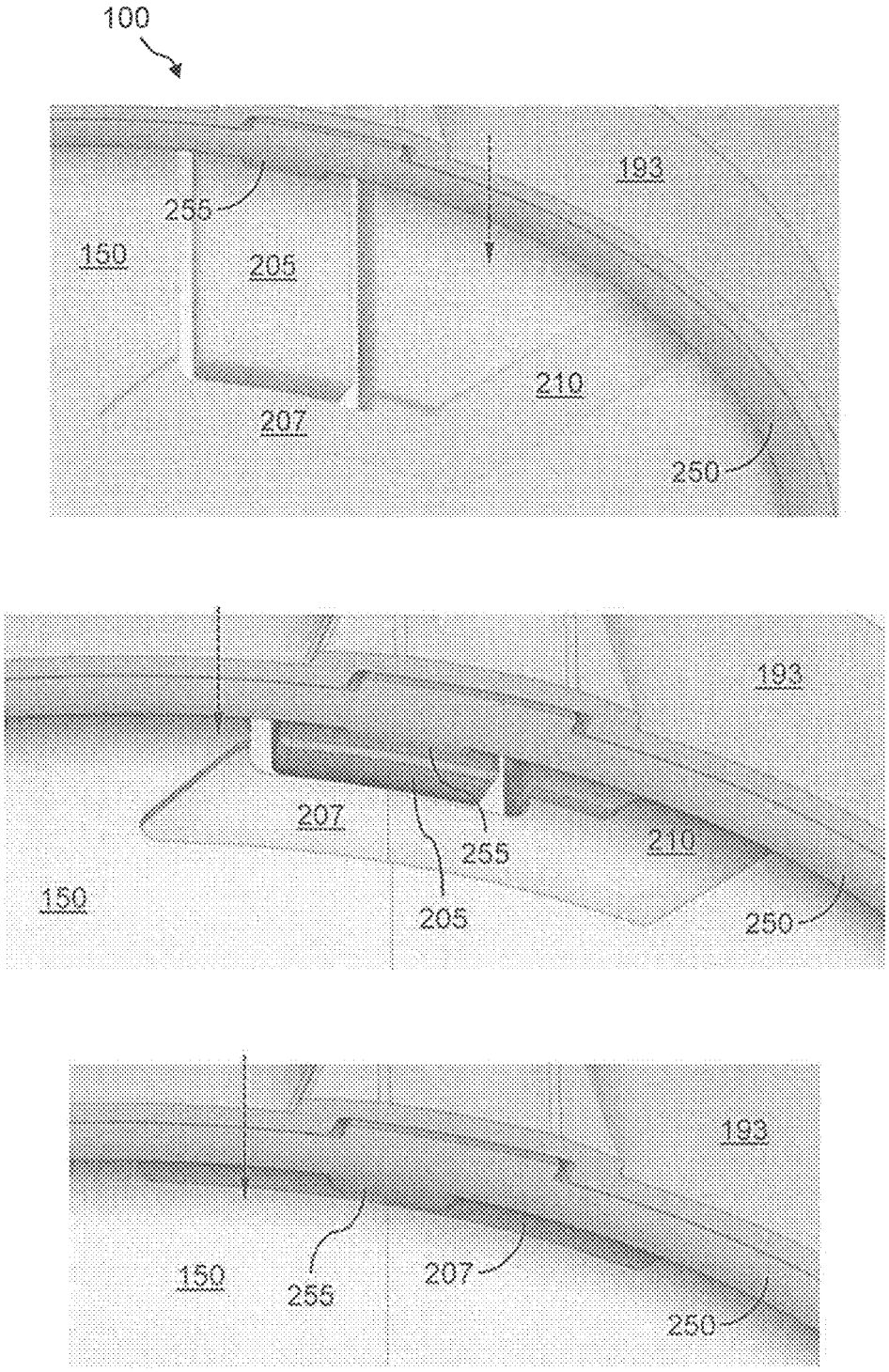
FIGS. 22-27 illustrate a process in which the inner ring portion and outer ring portion of the securing ring transition from a relaxed configuration to a constricted configuration.
Figure 23:
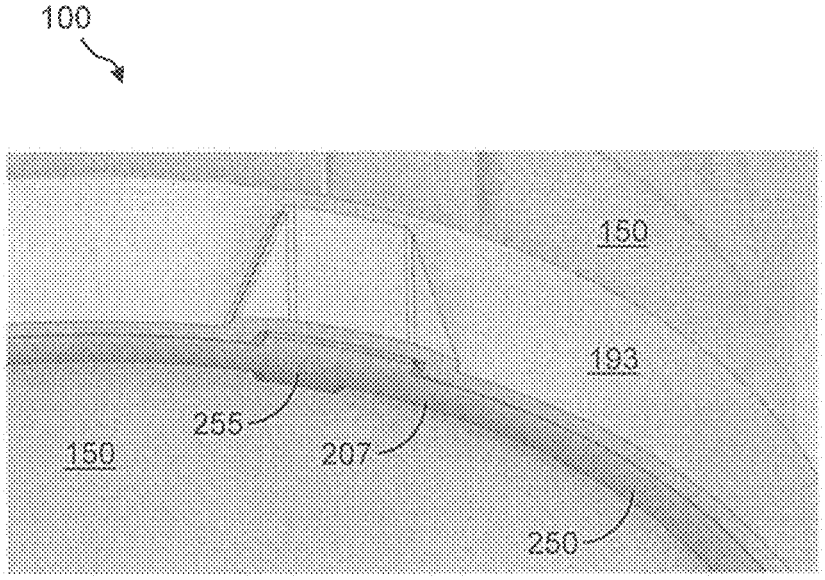
Figure 23:
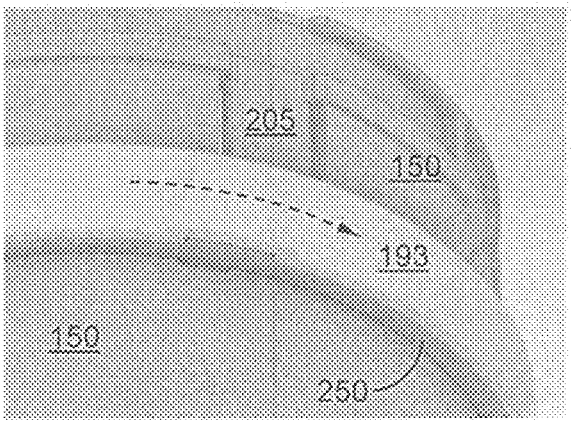
Figure 24:
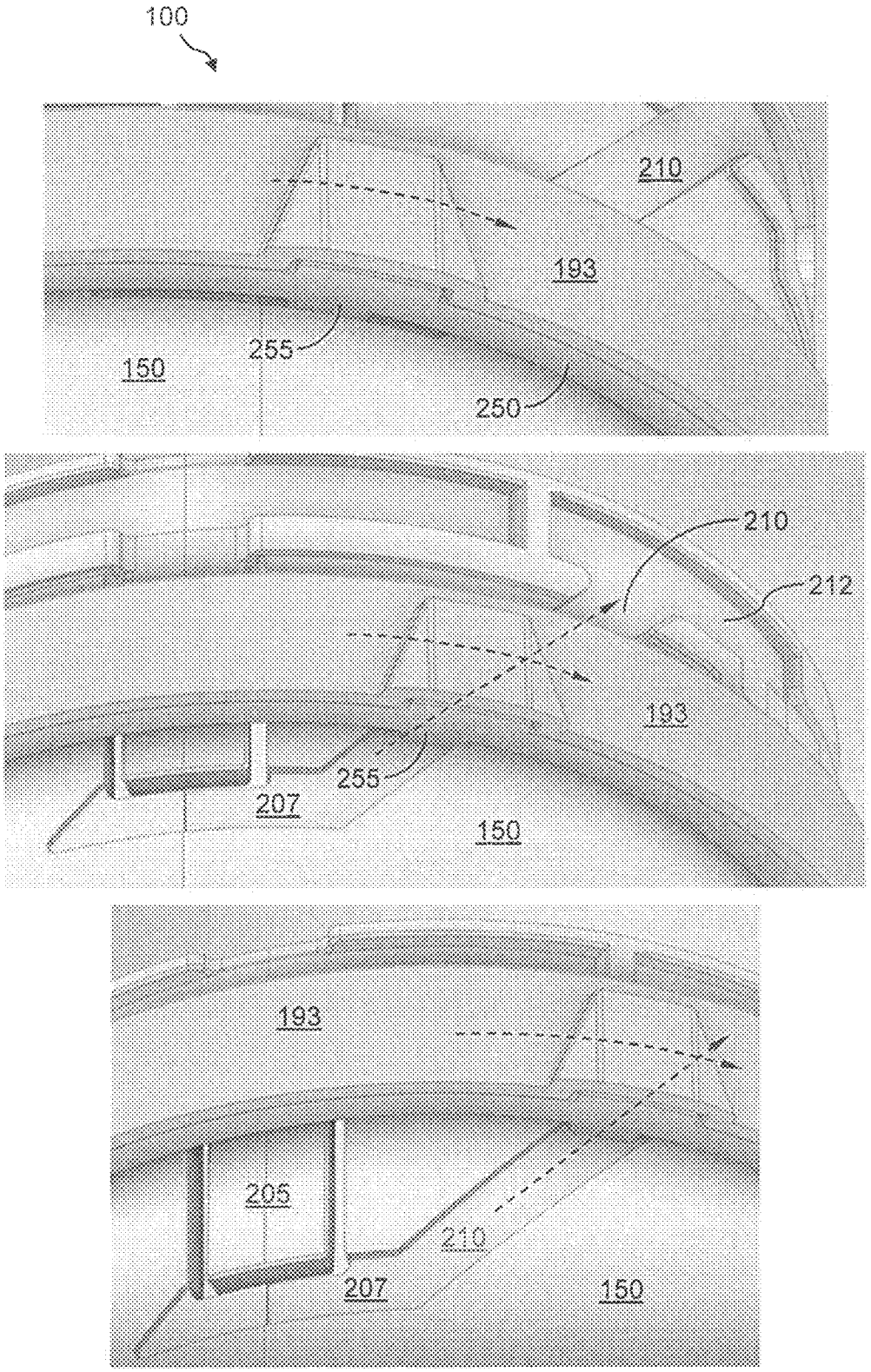
Figure 25:
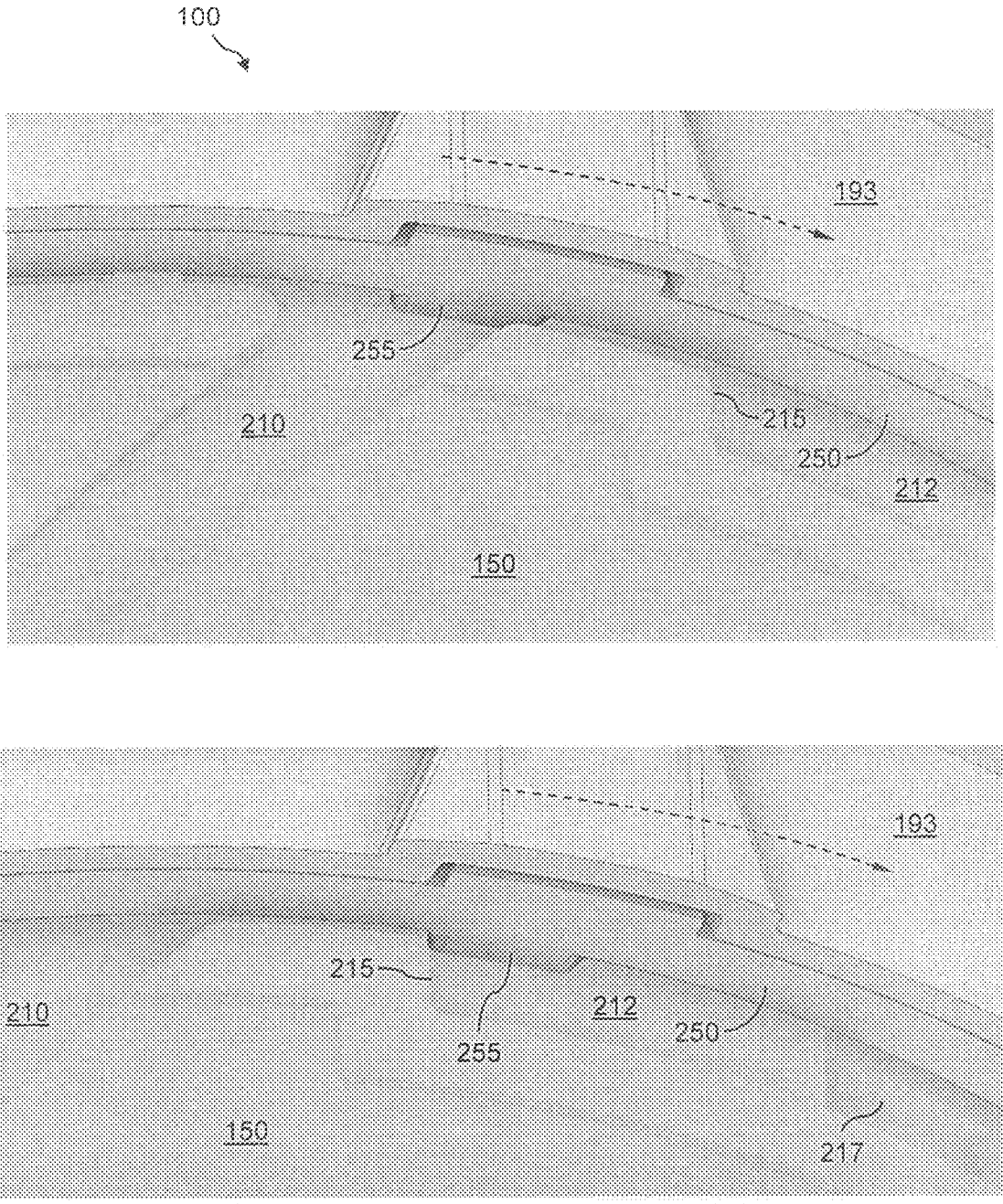
Figure 26:
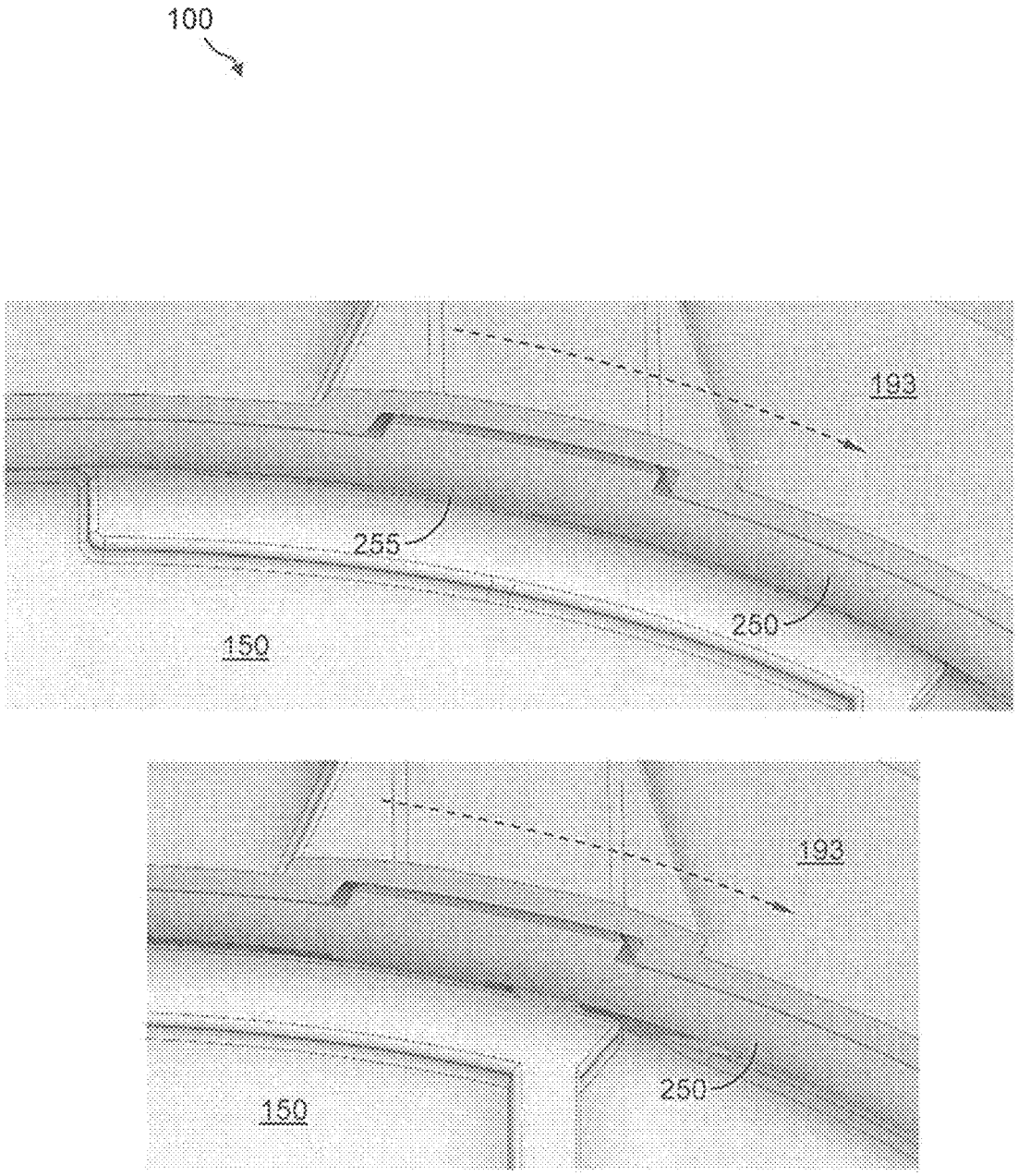
Figure 27:
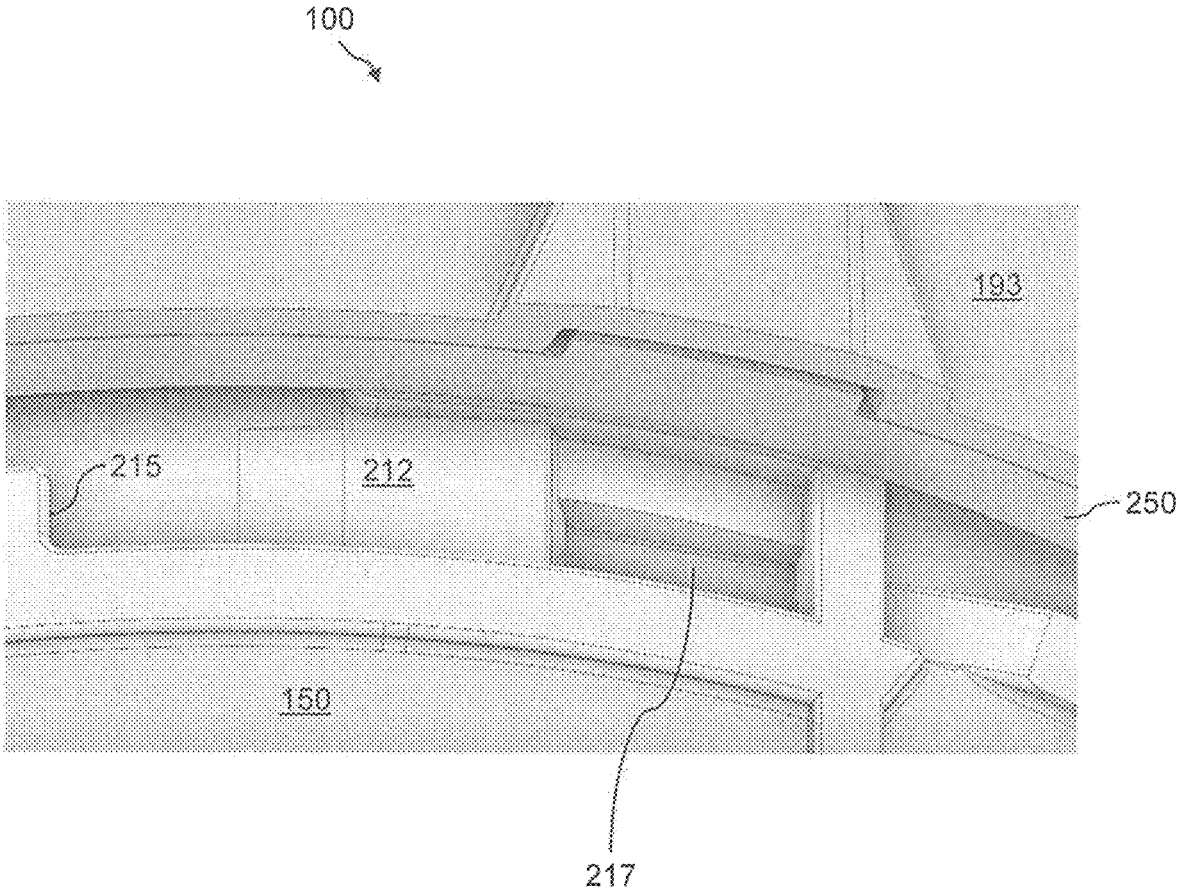

Referring to FIGS. 17A-17C, the lower container receiving portion 270 is shown in more detail. The lower container receiving portion 270 may include a liner wall 280, a liner floor 283, a liner opening 285, vent or drain openings 286, outer ridge 290, a divoted outer ring 292, an upper alignment tab 275, an inner engagement tab 297, and a transition feature 299.

Referring to FIGS. 18A-18H, the upper container receiving portion 150 is shown in more detail. The upper container receiving portion 150 may include upper container receiving walls 352, lower opening 354, upper opening 356, lower undercut 358, upper undercut 360, inner side alignment grooves or channels 362, side engagement snap tabs 205, lower slider grooves or channels 207, ramped channels 210, step feature 212, and cutout lock feature 214.

Referring to FIGS. 19A, 19B, 20A and 20B and FIG. 21, the upper container receiving 155 portion and the lower container receiving portion 130 mate together, and along with the holder base 110 are shown with the flexible sleeve 175 in place.

FIGS. 22-27, illustrate the process of transitioning the inner ring portion 250 and the outer ring portion 190 from a relaxed configuration to a constricted configuration. The inner alignment tab 254 may be moved downward in the engagement snap tab 205 into the lower slider grove or channel 207. The outer ring portion of the securing ring 190 is then rotated vertically, thereby causing the inner alignment tab 255 to move in an angle upwards to and along the ramped slider channel 210 to an undercut 212 so that the inner alignment tab 254 on continued rotation of the securing ring 190 eventually is positioned to a step feature 215 and a cutout locking feature 217 thereby moving the deformable sleeve from a relaxed configuration to a constricted configuration, namely reducing the interior diameter of the deformable sleeve 175 tightening the sleeve 175 around the can 230 or 240.

It is recognized that the embodiment described in the specification is for the gripping of beverage containers such as cans and bottles. One skilled in the art would recognize that the invention would be applicable to gripping other objects that are cylindrical in shape but vary from specific article to specific article. For example, the present invention could be used to store various articles in an upright position such as umbrellas, tools, sport rods, bats and clubs and the like having a cylindrical handle or shape. Other articles include cups, pipes, adult toys, writing instruments, jars, other non-beverage bottles, wine bottles and the like.

Having thus described certain embodiments of the present invention, it is to be understood that the invention defined by the appended claims is not to be limited by particular details set forth in the above description as many apparent variations thereof are possible without departing from the spirit or scope thereof as hereinafter claimed.

What is claimed is:

1. An adjustable beverage container holder, comprising:

a container receiving portion, a deformable sleeve, and a securing ring rotatable relative to the container receiving portion;

wherein the container receiving portion comprises a slot configured to receive a tab disposed on an interior of the securing ring and guide rotation of the securing ring from a container receiving configuration to a container securing configuration;

wherein a first end of the deformable sleeve is coupled to the container receiving portion and a second end of the deformable sleeve is coupled to the securing ring such that rotation of the securing ring from the container receiving configuration to the container securing configuration reduces an interior diameter of the deformable sleeve, thereby tightening the deformable sleeve about a container operatively disposed therein; and wherein the slot guides the securing ring to a relatively higher position in the container securing configuration relative to container receiving configuration, thereby further reducing the interior diameter of the deformable sleeve.

2. The adjustable beverage holder of claim 1, further comprising inner and outer alignment tabs of the securing ring for securing the second end of the deformable sleeve therebetween, and inner and lower container receiving portions of the container receiving portion for securing the first end of deformable sleeve therebetween.

3. The adjustable beverage holder of claim 1, wherein the deformable sleeve comprises a flexible polymeric material.

4. The adjustable beverage holder of claim 1, wherein the container receiving portion includes an upper receiving portion for the container.

5. The adjustable beverage holder of claim 1, wherein the securing ring comprises an outer ring portion and an inner ring portion.

6. The adjustable beverage holder of claim 5, wherein the securing ring is placed over an upper portion of the deformable sleeve so that the deformable sleeve is gripped between the outer ring portion and the inner ring portion.

7. The adjustable beverage holder of claim 5, wherein the tab disposed on an interior of the securing ring is moved downward in an engagement snap tab into a channel and the outer ring of the securing ring is rotated vertically causing an inner alignment tab to move along a ramped slider channel to an undercut to position the inner alignment tab in a step feature and a cutout locking feature to tighten the sleeve around a container.

8. The adjustable beverage holder of claim 1, wherein the lower container receiving portion further includes vent openings.

9. An adjustable holder for cylindrical objects comprising:

a cylindrical object receiving portion, a deformable sleeve, and a securing ring rotatable relative to the cylindrical object receiving portion;

wherein the cylindrical object receiving portion comprises a slot configured to receive a tab disposed on an interior of the securing ring and guide rotation of the securing ring from a cylindrical object receiving configuration to a cylindrical object securing configuration;

wherein a first end of the deformable sleeve is coupled to the cylindrical object receiving portion and a second end of the deformable sleeve is coupled to the securing ring such that rotation of the securing ring from the cylindrical object receiving configuration to the cylindrical object securing configuration reduces an interior diameter of the deformable sleeve, thereby tightening the deformable sleeve about a cylindrical object operatively disposed therein; and wherein the slot guides the securing ring to a relatively higher position in the cylindrical object securing configuration relative to cylindrical object receiving configuration, thereby further reducing the interior diameter of the deformable sleeve.

10. The adjustable holder of claim 9, further comprising inner and outer alignment tabs of the securing ring for securing the second end of the deformable sleeve therebetween, and inner and lower container receiving portions of the container receiving portion for securing the first end of deformable sleeve therebetween.

11. The adjustable holder of claim 9, wherein the deformable sleeve comprises a flexible polymeric material.

12. The adjustable holder of claim 9, wherein the container receiving portion includes an upper receiving portion for the container.

13. The adjustable holder of claim 9, wherein the securing ring comprises an outer ring portion and an inner ring portion.

14. The adjustable holder of claim 13, wherein the securing ring is placed over an upper portion of the deformable sleeve so that the deformable sleeve is gripped between the outer ring portion and the inner ring portion.

15. The adjustable holder of claim 13, wherein the tab disposed on an interior of the securing ring is moved downward in an engagement snap tab into a channel and the outer ring of the securing ring is rotated vertically causing an inner alignment tab to move along a ramped slider channel to an undercut to position the inner alignment tab in a step feature and a cutout locking feature to tighten the sleeve around a container.

16. The adjustable holder of claim 9, wherein the lower container receiving portion further includes vent openings.

17. The adjustable holder according to claim 9 adapted for cylindrical objects, wherein the cylindrical object is selected from the group consisting of umbrellas, tools, bats, sport rods, pipes, and writing instruments.

* * * * *